US010961668B2

(12) United States Patent
Shultz et al.

(10) Patent No.: US 10,961,668 B2
(45) Date of Patent: Mar. 30, 2021

(54) SPRAY CONTROL SYSTEM FOR LINE STRIPER SPRAYER

(71) Applicant: Graco Minnesota Inc., Minneapolis, MN (US)

(72) Inventors: Mark D. Shultz, Fridley, MN (US); Daniel D. Rohling, Corcoran, MN (US); David M. Larsen, Albertville, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 457 days.

(21) Appl. No.: 15/411,412

(22) Filed: Jan. 20, 2017

(65) Prior Publication Data

US 2017/0204571 A1 Jul. 20, 2017

Related U.S. Application Data

(60) Provisional application No. 62/280,767, filed on Jan. 20, 2016.

(51) Int. Cl.
*E01C 23/22* (2006.01)
*B05B 12/00* (2018.01)
(Continued)

(52) U.S. Cl.
CPC ..... *E01C 23/22* (2013.01); *A63C 19/065* (2013.01); *B05B 12/002* (2013.01);
(Continued)

(58) Field of Classification Search
CPC ..... E01C 23/22; E01C 23/222; A63C 19/065; A63C 2019/067; A63C 2203/12;
(Continued)

(56) References Cited

U.S. PATENT DOCUMENTS 4,369,856 A 1/1983 Nudd
4,518,121 A 5/1985 Smith
(Continued)

FOREIGN PATENT DOCUMENTS

CN 1920175 A 2/2007
CN 204000561 U 12/2014
(Continued)

OTHER PUBLICATIONS

First Chinese Office Action for CN Application No. 2017100426402, dated Oct. 19, 2018, pp. 6.
(Continued)

*Primary Examiner* — Jason J Boeckmann
(74) *Attorney, Agent, or Firm* — Kinney & Lange, P.A.

(57) ABSTRACT

A line striper having a spray control system includes a spray gun, a lever, first and second cables, a manual actuator, and an assisted control. The lever is configured to move between a spray position and an inactive position. The first cable is mechanically linked to the lever. The manual control is mechanically linked to the first cable and configured to pull the first cable rearward to move the lever into the spray position. The second cable is mechanically linked to the lever. The assisted control is configured to pull the second cable rearward to move the lever into the spray position. The lever is independently moveable relative to the first and second cables such that movement of the lever caused by the first cable does not compress the second cable and movement of the lever caused by the second cable does not compress the first cable.

20 Claims, 10 Drawing Sheets

(51) Int. Cl.
*A63C 19/06* (2006.01)
*B05B 13/00* (2006.01)

(52) U.S. Cl.
CPC ..... *E01C 23/222* (2013.01); *A63C 2019/067* (2013.01); *A63C 2203/12* (2013.01); *A63C 2203/22* (2013.01); *B05B 12/00* (2013.01); *B05B 13/005* (2013.01)

(58) Field of Classification Search
CPC ..... A63C 2203/22; B05B 12/00; B05B 12/02; B05B 13/005
USPC ..... 74/471 R, 473.2, 473.12, 502.5, 502.6; 188/24.22
See application file for complete search history.

(56) References Cited

U.S. PATENT DOCUMENTS

| | | | | |
|---|---|---|---|---|
| 5,168,769 | A | 12/1992 | Nebel | |
| 5,178,237 | A | 1/1993 | Ursel et al. | |
| 5,253,604 | A | 10/1993 | Bohlin | |
| 5,833,578 | A | 11/1998 | Potis | |
| 6,386,338 | B1 | 5/2002 | Powrozek | |
| 6,619,459 | B2 | 9/2003 | Gudlin | |
| 7,315,230 | B2 * | 1/2008 | Hoffman | H01F 7/1607 335/255 |
| 7,388,460 | B2 * | 6/2008 | Hoffman | F02N 15/067 335/219 |
| 8,261,887 | B2 * | 9/2012 | Tseng | B60T 11/06 188/2 D |
| 8,794,391 | B2 * | 8/2014 | Tseng | B60T 11/046 188/24.13 |
| 9,422,679 | B1 * | 8/2016 | Zurcher | E01C 23/22 |
| 2008/0114519 | A1 * | 5/2008 | DuFaux | B60T 7/16 701/70 |

FOREIGN PATENT DOCUMENTS

| | | | |
|---|---|---|---|
| CN | 204849555 | U | 12/2015 |
| GB | 2181768 | A | 4/1987 |
| WO | WO2013/170058 | A1 | 11/2013 |

OTHER PUBLICATIONS

Extended European Search Report for EP Application No. 17152436.6, dated May 24, 2017, 7 pages.

* cited by examiner

SPRAY CONTROL SYSTEM FOR LINE STRIPER SPRAYER

CROSS-REFERENCE TO RELATED APPLICATION

This application claims the benefit of U.S. Provisional Application No. 62/280,767 filed Jan. 20, 2016 for "Cable Junction For Line Striper Sprayer" by Mark D. Shultz, Daniel D. Rohling and David M. Larsen, the disclosure of which is incorporated by reference in its entirety.

BACKGROUND

The present disclosure relates generally to line striping machines, such as those used for applying painted stripes to roadways and athletic fields, and more specifically to a control system for controlling a spray gun of a line striping machine.

Line striping machines, also referred to as line stripers, typically comprise carts that are pushed by a user and/or are gas or electrically propelled. Line stripers typically include an engine for driving a pump and/or generating electrical power. The pump is fed a liquid, such as paint, from a reservoir on the line striper and supplies pressurized fluid to spray nozzles on the cart to discharge liquid towards a desired surface.

SUMMARY

A line striper having a spray control system includes a spray gun, a lever, first and second cables, a manual actuator, and an assisted control. The lever is configured to move between a spray position and an inactive position. The first cable is mechanically linked to the lever. The manual control is mechanically linked to the first cable and configured to pull the first cable rearward to move the lever into the spray position. The second cable is mechanically linked to the lever. The assisted control is configured to pull the second cable rearward to move the lever into the spray position. The lever is independently moveable relative to the first and second cables such that movement of the lever caused by the first cable does not compress the second cable and movement of the lever caused by the second cable does not compress the first cable.

A line striper having a spray control system includes a wheeled line striper with a spray gun, an operator station, and first and second cables. The operator station of the wheeled liner striper has a first control and a second control. The first cable is moveable by the first control to cause the spray gun to spray. The second cable is moveable by the second control to cause the spray gun to spray. The line striper is configured such that movement of the first cable to cause the spray gun to spray does not cause the second cable to move, and movement of the second cable to cause the spray gun to spray does not cause the first cable to move.

DETAILED DESCRIPTION

While paint will be used herein as exemplar when discussing the line striper and spray gun assembly, it will be understood that this is merely one example and that other solutions (e.g., water, oil, solvents, beads, flowable solids, pellets, etc.) can be applied by the line striper and spray gun assembly instead of paint. Also, while the term "line striper" is used herein as an example, it will be understood that the scope of this disclosure includes dispensing fluid and/or material on any surface in any pattern and is not limited to the painting of stripes.

Figure 1:
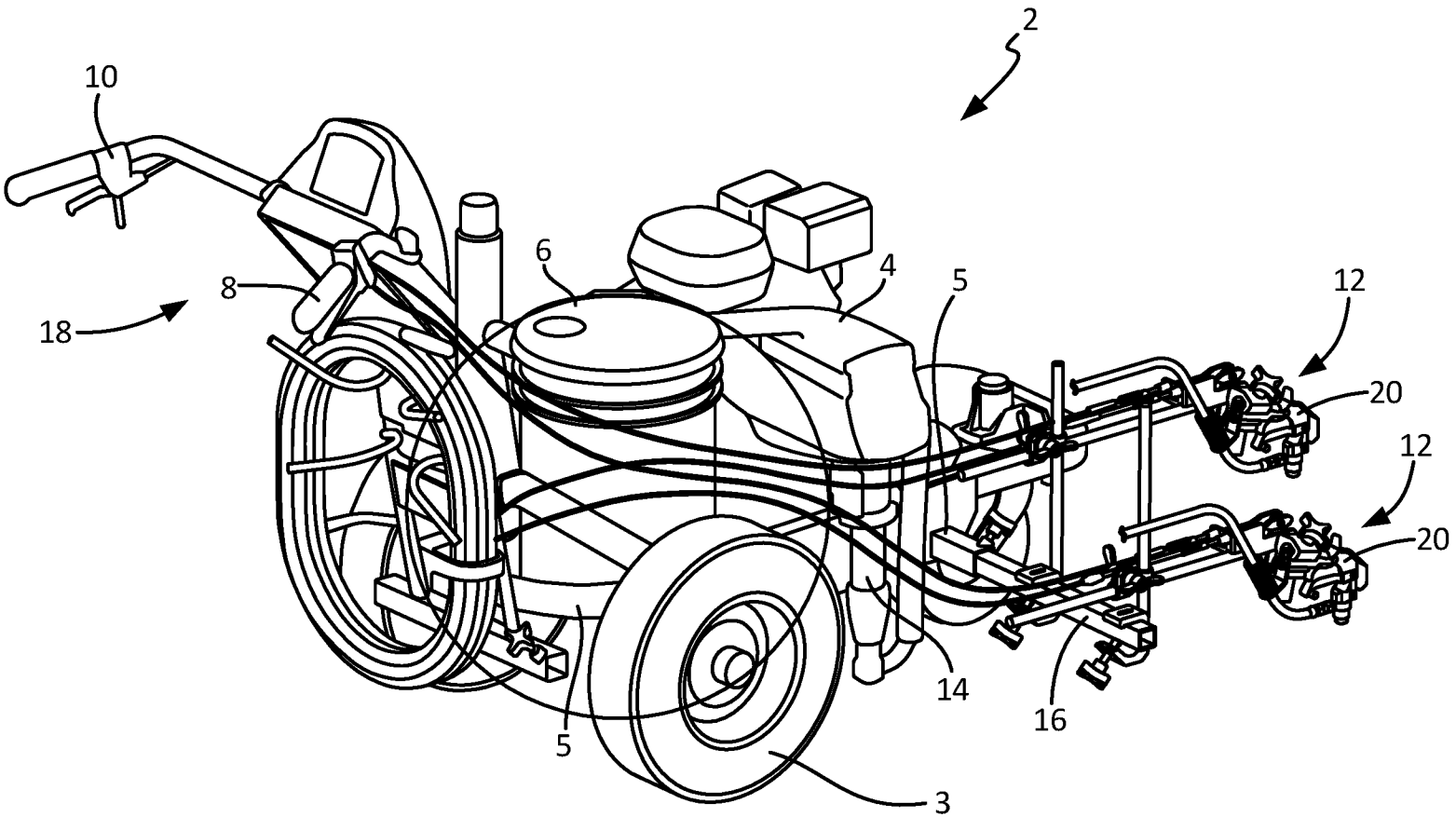
FIG. 1 is a perspective view of a line striper.

FIG. 1 is a perspective view of line striper 2, which includes wheels 3, engine 4, frame 5, reservoir 6, manual control 8 (also referred to as a manual actuator or a first control), assisted control 10 (also referred to as an auto control, an electric control, or a second control), spray gun assemblies 12, pump 14, mounting arm 16, operator station 18, spray guns 20, and hose 21. Line striper 2 is a machine used for applying painted stripes and other painted designs to roadways and athletic fields. Line striper 2 can be propelled by an outside source, such as being pushed or pulled by a human operator or by a vehicle, and/or line striper 2 can be self-propelled by a gas engine, electric motor, or other drive means. Line striper 2 includes other components not specifically described in this disclosure.

Engine 4 can be a gas-operated internal combustion engine or another type of engine that provides power to the components of line striper 2. Engine 4 can charge one or more batteries (not shown), provide direct mechanical input to pump 14 via a system of belts, pulleys, and/or other mechanics (not shown), and/or propel line striper 2, among other functions. The size and output of engine 4 can be configured to suit the needs of line striper 2.

Frame 5 is the main structural support for the components of line striper 2. Attached to frame 5, among other components, are wheels, engine 4, reservoir 6, manual control 8, assisted control 10, pump 14, mounting arm 16, and operator station 18. Frame 5 can be constructed from a variety of materials, including metal (such as aluminum), a metal alloy, a composite, or another material. Frame 5 can be made from one continuous and monolithic piece or can be a number of pieces fastened together through various means, including bolts, welds, or another type of fastener.

Reservoir 6 is a tank, such as a bucket, that contains paint or another suspension or solution that is to be applied to a surface by spray guns 20 of line striper 2. Reservoir 6 can be constructed from a variety of materials, including plastic, metal (such as aluminum), a metal alloy, a composite, or another material. Reservoir 6 can be detachable to allow for the addition of paint into or removal of paint from reservoir 6 at a location distant from line striper 2. Further, line striper 2 can include multiple reservoirs 6 with connections to each spray gun 20 so that different types of paint can be carried upon line striper 2 and applied by each spray gun 20.

Pump 14 pulls paint from reservoir 6 and, by action of a piston or another type of pump mechanism, pressurizes the paint and supplies the paint to spray guns 20 for application of the paint to the desired surface. Pump 14 is connected to hose 21, which conveys paint from reservoir 6 to spray guns 20. Line striper 2 can include multiple pumps 14 to pressurize and supply paint to multiple spray guns 20, or one pump 14 can be configured to supply paint to multiple spray guns 20.

Operator station 18 is a station on line striper 2 where the user sits or stands and from which the user controls the operation of line striper 2, including the activation of spray guns 20. Operator station 18 can include handles, electronic components (such as a computer processor and display screen), engine controls, speed and directional controls, and other components that allow the user to operate line striper 2. The components of operator station 18 can be attached to one another and/or frame 5 through various fasteners and can have a configuration and/or orientation that allows for line striper 2 to be user friendly, durable, and easily manufactured and maintained.

Manual control 8 (also referred to as a manual actuator or a first control) can be located near a handlebar of operator station 18 and allows the user to manually control the application of paint by each of the spray guns 20. Manual control 8 can be a handle on the handlebar that pivots/actuates to allow the user to turn the spray gun on and off and adjust the amount of paint being applied by each spray gun 20. Manual control 8 can generate tension on a first cable that runs from the handlebar of operator station 18 to a lever adjacent one or more gun assemblies 20 to remotely pull a trigger on spray gun 20 to rotate the lever into a spray position and activate spray gun 20. For multiple spray guns 20, manual control 8 can include multiple handles near the handlebar and multiple cables to control the application of paint by each spray gun 20. Manual control 8 is described in detail with regards to FIG. 5.

Assisted control 10 (also referred to as an auto control, an electric control, or a second control) can be located near another handlebar of operator station 18 or be incorporated into a controller, such as an electronic component/computer processor, to control the application of paint by each of the spray guns 20. The controller can include preprogramed paint spray patterns that the user can select so that line striper 2 applies paint without the need for the user to use manual control 8. Assisted control 10 can include a button or another input which is operatively connected to the controller and/or other components (such as solenoids, plungers, and springs) that generates tension on a second cable to remotely pull the trigger on spray gun 20 to rotate the lever into the spray position to activate spray gun 20. For multiple spray guns 20, assisted control 10 can include multiple buttons to communicate with controller and multiple cables to control the application of paint by each spray gun 20. Assisted control 10 can be a component of operator station 18. Assisted control 10 is described in greater detail with regards to FIG. 4.

Mounting arm 16 is a support member that is attached to and extends laterally away from frame 5 near a front of line striper 2. Mounting arm 16 provides a structural support to which multiple gun assemblies 12 can attach. In some embodiments, mounting arm 16 is extendable and retractable from frame 5 of line striper 2 to adjust the location of mounting arm 16 relative to frame 5. Mounting arm 16 can have a variety of shapes, configurations, and orientations, but mounting arm 16 as shown in FIG. 1 is a hollow, elongated bar that has a square cross section. An end of mounting arm 16 can be configured to insert into a casing of frame 5 to hold mounting arm 16 in place relative to frame 5.

Gun assembly 12 holds one or more spray guns 20 and attaches spray gun 20 to mounting arm 16. Line striper 2 can include multiple gun assemblies 12, and multiple gun assemblies 12 can be attached to one mounting arm 16. Gun assembly 12 is adjustable to slide along mounting arm 16, move spray gun 20 up or down, and move spray gun 20 forward or rearward. Thus, gun assembly 12 is able to adjust the location of spray gun 20 in any direction. Gun assembly 12 is able to be removed from mounting arm 16 to completely disconnect from line striper 2. While the disclosed embodiment shows two gun assemblies 12, line striper 2 can include one or more than two gun assemblies 12. Gun assembly 12 includes a portion of a spray control system which controls the activation of spray gun 20 through the use of manual control 8 and assist control 10. Gun assembly 12 and the spray control system are described in greater detail below.

Spray gun 20 is a component of gun assembly 12 and is located at the front of line striper 2. Spray gun 20 is supplied paint from reservoir 6 through the use of pump 14 and hose 21 and applies the paint to a desired surface. Spray gun 20 is able to be secured relative to frame 5 and the other components of line striper 2 such that movement of line striper 2 controls the movement of spray gun 20. Spray gun 20 can include a trigger that activates spray gun 20. The trigger is able to be pulled by manual control 8, assisted control 10, and directly by the user. Spray gun 20 is also able to be removed from gun assembly 12 to allow a user to apply paint to a surface that is distant from line striper 2 during generally stationary work (while still allowing spray gun 20 to be attached to hose 21 and supplied paint from reservoir 6), such as for stenciling a design or applying paint in another manner. The disclosed embodiment shows one spray gun 20 corresponding to one gun assembly 12, but gun assemblies 12 and spray guns 20 can be configured such that two or more spray guns 20 are attachable to one gun assembly 12. Each spray gun 20 can be operated independently from one another. Further, line striper 2 can include multiple hoses 21 to convey paint to multiple spray guns 20. As mentioned above, gun assembly 12 is adjustable to adjust the location of spray gun 20 relative to frame 5 and mounting arm 16.

Figure 2A:
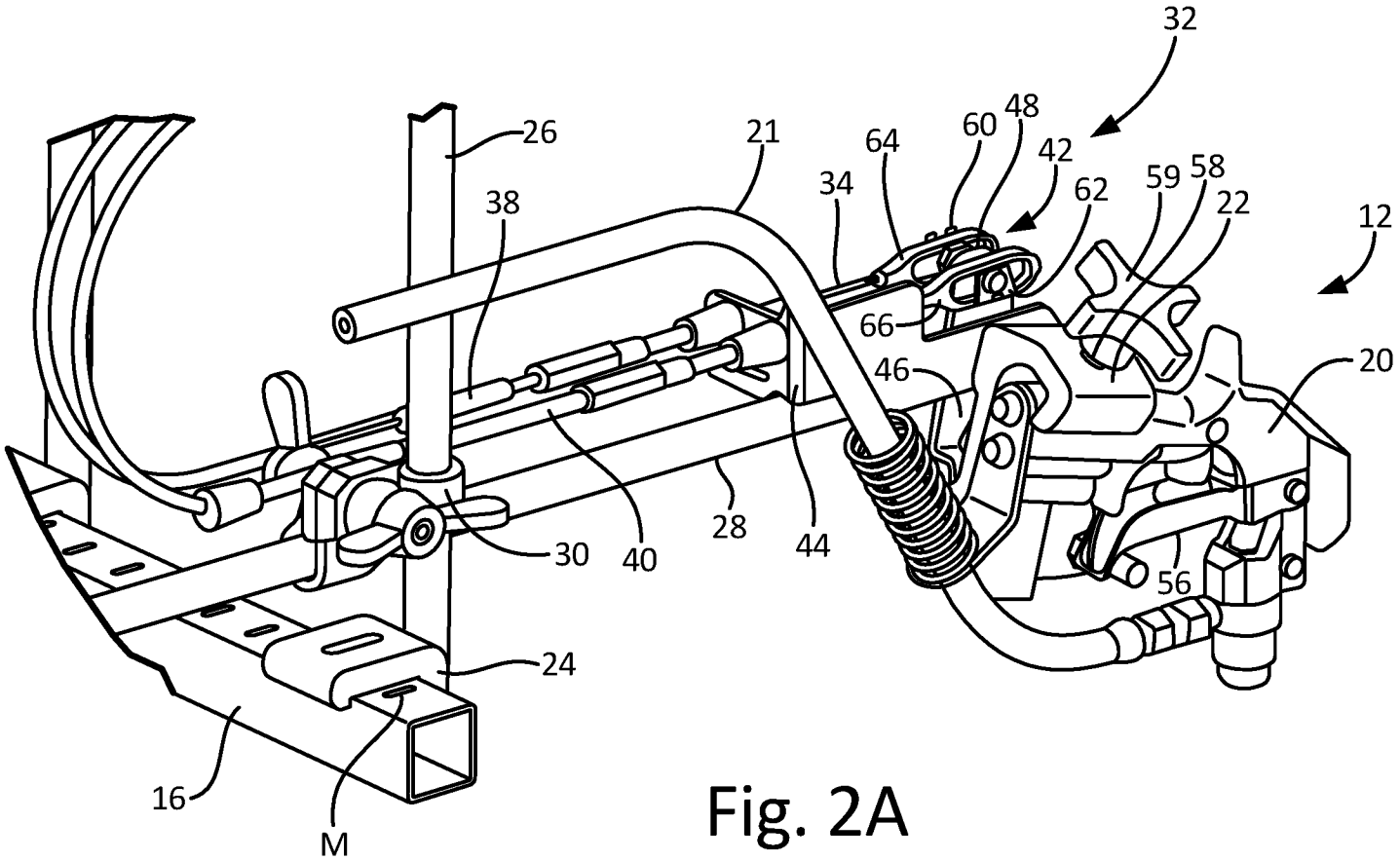
FIG. 2A is a rear perspective view of a spray control system.
Figure 2B:
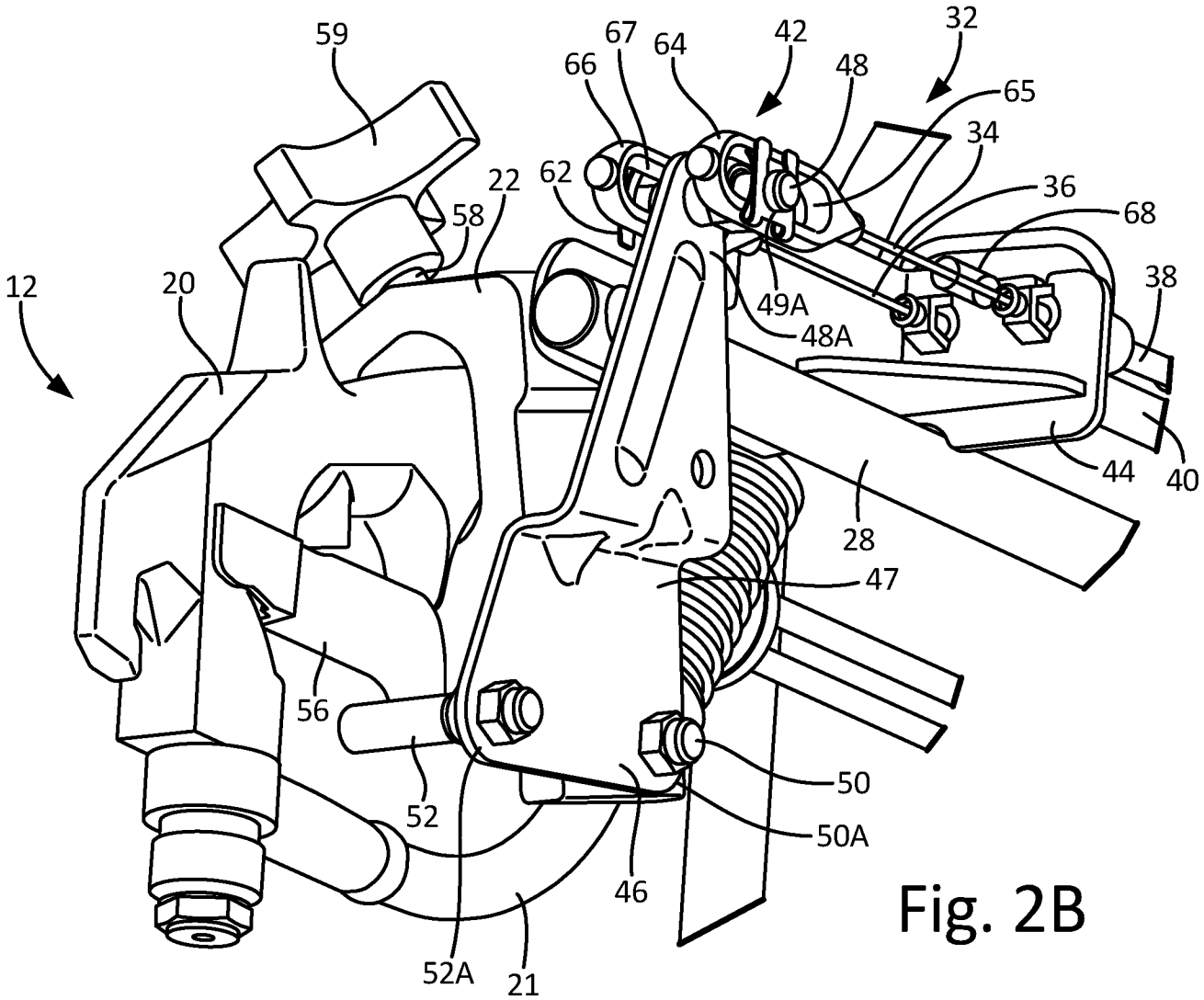
FIG. 2B is a front perspective view of the spray control system in FIG. 2A.
Figure 2C:
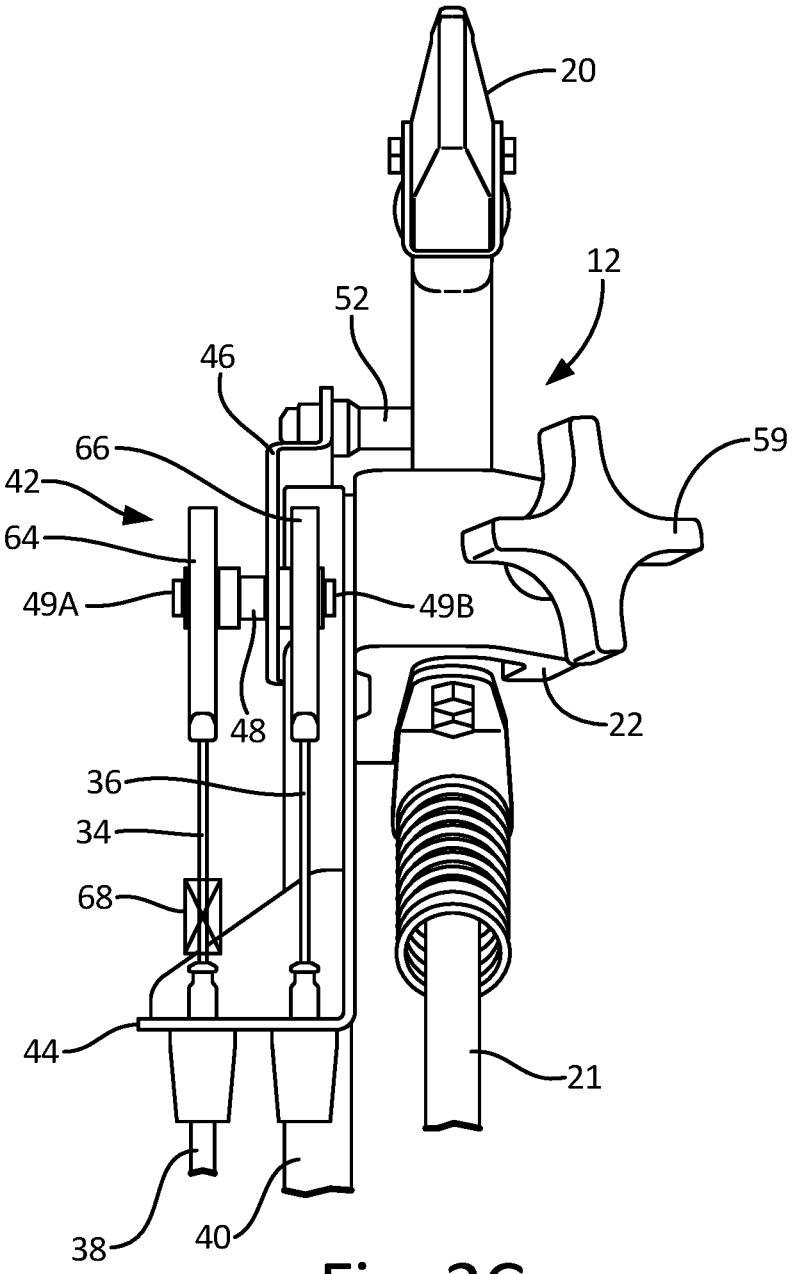
FIG. 2C is a top plan view of the spray control system in FIG. 2A.

FIG. 2A is a rear perspective view of gun assembly 12 and a portion of spray control system 32; FIG. 2B is a front perspective view of a portion of gun assembly 12 and a portion of spray control system 32; and FIG. 2C is a top plan view of a portion of gun assembly 12 and a portion of spray control system 32. FIGS. 2A-2C will be discussed together. FIGS. 2A-2C shows mounting arm 16 with measurement markings M. Gun assembly 12 includes gun 20, hose 21, gun holder 22, clamp 24, vertical bar 26, extension bar 28, and connector 30. Spray control system 32 includes manual control 8 and assisted control 10 shown in FIG. 1, first cable 34, second cable 36, first sheath 38, second sheath 40, cable junction 42, bracket 44, and lever 46 (having lever body 47, pin 48, pivot 50, and finger 52). Gun holder 22 includes trigger 56 and fastener 58 with handle 59. Pin 48 includes first cap 60 and second cap 62. Cable junction 42 includes first slotted connector 64 and second slotted connector 66. Second cable 36 includes resilient member 68. Spray control system 32 is shown in FIGS. 2A-2C in a neutral, inactive position in which neither first cable 34 nor second cable 36 is being pulled to activate spray gun 20 to apply paint.

Mounting arm 16 is attached to frame 5 such that mounting arm 16 is prevented from movement relative to frame 5 of line striper 2. Along a top of mounting arm 16 are measurement markings M, which indicate distance along mounting arm 16 to aid in placing gun assemblies 12 along mounting arm 16 relative to other gun assemblies 12 and to frame 5. Measurement markings M can show any units of measurement, including SI units (centimeters) and English units (inches), and measurement markings M can be imprinted or etched onto mounting arm 16 or can be painted or otherwise applied using another material different in substance and/or color than that of mounting arm 16.

Clamp 24 attaches gun assembly 12 to mounting arm 16. Multiple clamps 24 along with multiple gun assemblies 12 can be attached to mounting arm 16. Clamp 24 has a generally G-shaped profile with an opening through which mounting arm 16 can extend. The G-shaped profile of clamp 24 allows clamp 24 and gun assembly 12 to be installed upon and removed from mounting arm 16 without having to slide clamp 24 and gun assembly 12 on or off of an end of mounting arm 16 (and without having to remove other gun assemblies 12 from mounting arm 16). In FIG. 2A, the opening of clamp 24 faces rearward such that clamp 24 would move forward to be removed from mounting arm 16. However, other configurations of clamp 24 can include clamp 24 with an opening that faces forward.

Vertical bar 26 is a shaft that is attached to clamp 24 at one end and extends upward/vertical relative to mounting arm 16. The disclosed embodiment shows vertical bar 26 extending generally vertical, but vertical bar 26 can extend away from clamp 24 and mounting bar 16 at another angle. Vertical bar 26 can be constructed from a variety of materials, such as plastic, metal (such as aluminum), a metal alloy, a composite, or another material. While vertical bar 26 is shown to be a straight shaft having a circular cross-sectional shape, vertical bar 26 can be curved or wavy and can have a variety of cross-sectional shapes. However, vertical bar 26 should be configured to allow connector 30 (which connects extension bar 28 to vertical bar 26) to slide along vertical bar 26. Vertical bar 26 can also include a stopper at another end (the end distant from the end that is attached to clamp 24) to prevent connector 30 from sliding off of vertical bar 26.

Extension bar 28 is a shaft that is attached to vertical bar 26 by connector 30 and extends forward toward a front of gun assembly 12. The disclosed embodiment shows extension bar 28 extending generally horizontal relative to mounting bar 16 and vertical bar 26, but extension bar 28 can extend at another angle, such as an angle that is partially upward or downward. Extension bar 28 can be constructed from a variety of materials, such as plastic, metal (such as aluminum), a metal alloy, a composite, or another material. While extension bar 28 is shown to be a straight shaft having a circular cross-sectional shape (similar to vertical bar 26), extension bar 28 can be curved or wavy and can have a variety of cross-sectional shapes. However, extension bar 28 should be configured so as to not interfere with hoses 21, first cable 34, and second cable 36, and extension bar 28 should be configured to allow connector 30 to slide along extension bar 28.

Connector 30 connects vertical bar 26 to extension bar 28 and allows adjustment of extension bar 28 relative to mounting arm 16 and clamp 24. Connector 30 includes one vertical orifice with a corresponding fastener and handle through which vertical bar 26 can extend, slide within, and be secured so as to be prevented from movement relative to clamp 24. This functionality of connector 30 and vertical bar 26 allows the vertical adjustment of spray gun 20 relative to mounting arm 16. Connector 30 also includes a horizontal orifice with a corresponding fastener and handle through which extension bar 28 can extend, slide within, and be secured so as to be prevented from movement relative to vertical bar 26. This functionality of connector 30 and extension bar 28 allows the forward-rearward adjustment of spray gun 20 relative to mounting arm 16. Thus, connector 30 allows for the up-down (i.e., vertical) and forward-rearward (horizontal) adjustment of spray gun 20 while also tightening to secure vertical bar 26 and extension bar 28 in place relative to clamp 24.

Gun holder 22 is attached to an end of extension bar 28 and is configured to allow spray gun 20 to attach to and detach from gun assembly 12. Gun holder 22 can be attached to extension bar 28 by a variety of means, including welding, bolts, screws, or other fasteners. Gun holder 22 can include a C-shaped rail into which a portion of spray gun 20 slides, or gun holder 22 can include fastener 58 with handle 59. Fastener 58 is configured to allow attachment and detachment of spray gun 20. Fastener 58 can include a screw or another type of fastener that is able to tighten through the use of handle 59 to contact and hold spray gun 20 relative to extension bar 28. Fastener 58 is also able to loosen through the use of handle 59 to disengage spray gun 20 to allow spray gun 20 to be removed from gun assembly 12 to apply paint distant from gun assembly 12 and line striper 2. Spray gun 20 can be secured in gun holder 22 for spraying while line striper 2 is in motion (e.g., spraying stripes) but is removable for generally stationary work (e.g., stenciling). Gun holder 22 with fastener 58 and handle 59 should be positioned so as to hold spray gun 20 adjacent to lever 46 such that trigger 56 of spray gun 20 is adjacent to finger 52 of lever 46 to allow for finger 52 to push trigger 56 when first cable 34 and/or second cable 36 pulls pin 48 to rotate lever 46 into the spray position. While the disclosed embodiment shows gun assembly 12 having gun holder 22, other embodiments can include a configuration in which gun holder 22 is not present and spray gun 20 is attachable directly to extension bar 28.

Spray gun 20 is located at the forward end of gun assembly 12 and applies paint to a desired surface. Spray gun 20 is attachable to gun holder 22 of gun assembly 12 such that spray gun 20 can be activated by manual control 8 and assisted control 10 remotely from spray gun 20 to control the application of paint as is described in greater detail below. The control of spray gun 20 can be from a distance, such as from operation station 18 of line striper 2. Moreover, spray gun 20 is detachable from gun holder 22 and gun assembly 12 such that spray gun 20 can be used to apply paint distant from line striper 2 (through the manipulation of the trigger on spray gun 20 by a user). The detachment of spray gun 20 to apply paint distant from line striper 2 may be useful when stenciling a design or applying paint in another, non-striping manner.

Trigger 56 is a component of spray gun 20 and is configured to actuate to activate spray gun 20 to spray paint on a desired surface. When spray gun 20 is held in gun holder 22 facing downward, trigger 56 extends horizontally rearward and can be moved into the spray position by being pulled or pushed upward (in the case of spray control system 32, trigger 56 is pushed upward by finger 52). In the neutral, inactive position, trigger 56 is in a downward position relative to the active position. Trigger 56 is adjacent to finger 52 of lever 46 such that upward movement of finger 52 causes trigger 56 to move upward to activate spray gun 20. When trigger 56 and finger 52 are in the neutral position, spray gun 20 and trigger 56 should be able to be removed from gun holder 22 (and removed from a location adjacent to finger 52) without accidentally pulling trigger 56 and activating spray gun 20. Trigger 56 can be configured to allow a user to pull trigger 56 by hand to activate spray gun 20 when spray gun 20 is distant from line striper 2.

Paint is routed through hose 21 from reservoir 6 to spray gun 20 by pump 14. Paint is released (e.g., in a spray) from spray gun 20 by actuation of trigger 56 of spray gun 20. For example, pulling of trigger 56 opens a needle valve within spray gun 20 to release the paint as is known in the art. Being that a user occupies operator station 18 (as shown in FIG. 1) while line striper 2 is used for paint application, spray gun 20 is remote from the user during paint application (e.g., spraying). Therefore, trigger 56 is remotely actuated. As is further explained below, trigger 56 is remotely actuated by finger 52 on lever 46, which is rotated into the spray position by first cable 34 and second cable 36, which terminate at cable junction 42.

Spray control system 32 allows for a user of line striper 2 to control the application of paint by spray gun 20 remotely, such as from operator station 18 near a rear of line striper 2. Spray control system 32 has manual control 8 and assisted control 10 that each control the application of paint by spray gun 20 independently such that the movement of lever 46 into the spray position to activate spray gun 20 by manual control 8 does not affect assisted control 10 and movement of lever 46 into the spray position to activate spray gun 20 by assisted control 10 does not affect manual control 8. The components of spray control system 32 are described below, but the described configuration of spray control system 32 is provided only as an example and other configurations not specifically disclosed that perform the functionality of spray control system 32 are within the scope of this disclosure.

First cable 34 is a line that extends between a first end that is mechanically linked to pin 48 of lever 46 at a front of line striper 2 and a second end that is mechanically linked to manual control 8 at operator station 18 at a rear of line striper 2. The mechanical linkage of the second end of first cable 34 to manual control 8 is described in greater detail with regards to FIG. 5. First cable 34 can be any cord, link, or wire that is able to transfer a pull on the second end by manual control 8 to a rearward pull on the first end and consequently a rearward pull on pin 48 to move lever 46 into the spray position. First cable 34 can be constructed from any material, including plastic, steel, a synthetic material, a composite material, or another type of material that can handle the stresses caused by the pull of first cable 34 by manual control 8 and a forward pull by resilient member 68 located near the first end of first cable 34 to move first cable 34 back into a neutral position that is not pulling on pin 48 to rotate lever 46 into the spray position.

Second cable 36 is similar to first cable 34 in materials and functionality. Second cable 36 is a line that extends between a first end that is mechanically linked to pin 48 of lever 46 at a front of line striper 2 and a second end that is mechanically linked to assisted control 10, which can be located near the rear of line striper 2 distant from the first end of second cable 36. The mechanical linkage of the second end of second cable 36 to assisted control 10 is described in greater detail with regards to FIG. 4. Second cable 36 is able to transfer a pull on the second end by assisted control 10 to a rearward pull on the first end and consequently a rearward pull on pin 48 to move lever 46 into the spray position. Second cable 36 is also able to transfer a forward push on the second end of second cable 36 by assisted control 10 to a forward push on the first end of second cable 36 to move the first end of second cable 36 into a neutral position in which second cable 36 is not pulling on pin 48 to rotate lever 46 into the spray position.

Resilient member 68 is a spring or another type of resilient member located near the first end of first cable 34. Resilient member 68 can surround first cable 34 and bias first cable 34 forward into the neutral, inactive position so that a rearward side of first slotted connector 64 is not in contact with pin 48 when manual control 8 is not pulling on first cable 34. Thus, resilient member 68 ensures first cable 34 and first slotted connector 64 are in the forward, inactive position at all times other than when manual 8 is pulling first cable 34 rearward. In the disclosed embodiment, resilient member 68 is a spring that uses bracket 44 as an anchor/stationary support member, but resilient member 68 can have another configuration able to bias first cable 34 forward.

First sheath 38 is a covering that surrounds and protects first cable 34, and second sheath 40 is a covering that surrounds and protects second cable 36. First sheath 38 and second sheath 40 can be configured to be stationary relative to first cable 34 and second cable 36, respectively, so that first cable 34 and second cable 36 slide within first sheath 38 and second sheath 40, respectively. Alternatively, first sheath 38 and second sheath 40 can be bonded to or otherwise attached to first cable 34 and second cable 36, respectively, so as to move forward and rearward with first cable 34 and second cable 36, respectively, when first cable 34 and second cable 35 are pulled rearward and pulled/pushed forward by manual control 8 or assisted control 10. First sheath 38 and second sheath 40 can be constructed from a variety of materials, including plastic, rubber, a metal, a composite, or another material. In other embodiments, first sheath 38 and second sheath 40 are not present such that first cable 34 and second cable 36 do not have a protective covering.

Cable junction 42 is a location at which the first ends of first cable 34 and second cable 36 mechanically link to pin 48 of lever 46 and at which bracket 44 connects to extension bar 28. Bracket 44 is a structural member that provides support to the first end of first cable 34, resilient member 68 surrounding first cable 34 near the first end of first cable 34, and the first end of second cable 36. Bracket 44 is connected to and extends along a top of extension bar 28 and has a generally L-shaped configuration when viewed from a top (as shown in FIG. 2C). Bracket 44 can have other components that increase strength and rigidity, such as a triangular-shaped member that extends between the two legs of the L-shaped bracket 44. Bracket 44 includes a plate which first cable 34 and second cable 36 extend through and are supported by. On one side of the plate of bracket 44 are first sheath 38 and second sheath 40, which terminate at the plate of bracket 44. On the other side of the plate of bracket 44 are first cable 34, second cable 36, and resilient member 68, which is supported by and uses bracket 44 as an anchor/stationary support member to bias first cable 34 forward into the neutral, inactive position. Bracket 44 can be constructed from a variety of materials, including a metal (such as aluminum), a metal alloy, plastic, a composite, or another type of material. However, bracket 44 should be constructed from a material and/or have a configuration that has sufficient strength and rigidity to withstand the forces exerted on bracket 44 by the other components of spray control system 32 and line striper 2. While the disclosed embodiment shows a configuration that includes bracket 44, other embodiments can include spray control system 32 that does not include bracket 44 or includes a different configuration, orientation, or size of bracket 44.

Lever 46 is a generally triangular member that includes lever body 47, pin 48, pivot 50, and finger 52. The triangular portion of lever 46 is lever body 47, which is shown in the disclosed embodiment as a right triangle. Pivot 50 is located at corner 50A of lever body 47 that has a right angle, pin 48 is located at corner 48A of lever body 47 that is an upper end adjacent extension bar 28 and bracket 44, and finger 52 is located at corner 52A of lever body 47 that is a forward end adjacent trigger 56 of spray gun 20. Lever 46 has a stair-stepping configuration at a generally middle in which lever body 47 juts outward away from spray gun 20. With such a configuration, a lower portion of lever 46 (below the stair step) is approximately in vertical alignment with second cable 36 (as shown in FIG. 2C). The lower portion of lever 46 being in alignment with second cable 36 reduces the force needed by second cable 36 to pull pin 48 rearward to rotate lever 46. This reduction in force is advantageous because a smaller power supply is needed for assisted control 10. The components of lever 46 can be constructed from a variety of materials, including a metal (such as aluminum), a metal alloy, a composite, or another type of material able to transfer the forces exerted on pin 48, through lever body 47, and to finger 52.

Lever 46 is moveable between the spray position and the inactive position. Lever 46 can be configured to rotate about pivot 50 into the spray position when pin 48 is pulled rearward by first cable 34 or second cable 36. Finger 52 of lever 46, which is adjacent to trigger 56 on spray gun 20, engages/contacts trigger 56 to activate spray gun 20 to apply paint when lever 46 is rotated into the spray position. When lever 46 is in the neutral, inactive position, pin 48 is in the forward position and finger 52 is not engaged with trigger 56. Other components of spray control system 32, such as a biasing member, can be configured to bias lever 46 into the neutral, inactive position when not being pulled by first cable 34 or second cable 36. In the neutral, inactive position, lever 46 is rotated such that pin 48 is forward of and finger 52 is downward from the spray position. While lever 46 is shown as a generally triangular member, lever 46 can have other configurations. Additionally, the components of lever 46 can be one continuous and monolithic piece or can be a number of pieces fastened together.

Pin 48 is located at corner 48A of lever 46. Pin 48 as shown in the disclosed embodiment as a shaft that extends outward from each side of lever body 47, but pin 48 can be any sliding member having any shape that is able to slide relative to bracket 44 within first slotted connector 64 and second slotted connector 66. Thus, pin 48 is just one example of a sliding member. Pin 48 can extend outward from lever body 47 at any angle, but is shown in the disclosed embodiment to extend outward at a perpendicular angle. Pin 48 can be one continuous and monolithic piece that extends through a hole in lever body 47, or pin 48 can be two pieces fastened to lever body 47. Pin 48 has first side 49A that extends outward away from lever body 47 to interact with first cable 34 through first slotted connector 64. As is described below, at an end of first side 49A is first cap 60, which is connected to pin 48 to prevent first slotted connector 64 from sliding off the end of first side 49A of pin 48. Pin 48 has second side 49B that extends outward away from lever body 47 opposite first side 49A. Second side 49B extends outward from the side of lever body 47 that is adjacent extension bar 28. Second side 49B of pin 48 interacts with second cable 36 through second slotted connector 66. At an end of second side 49B is second cap 62, which is connected to pin 48 to prevent second slotted connector 64 from sliding off the end of second side 49B of pin 48. Pin 48 is configured to be pulled rearward by first slotted connector 64 (which is pulled rearward by first cable 34) and second slotted connector 66 (which is pulled rearward by second cable 36). The movement of pin 48 rearward causes lever 46 to rotate about pivot 50, which in turn causes finger 52 to move upward to engage trigger 56 to activate spray gun 20. While pin 48 is shown as a cylindrical shaft, pin 48 can have other shapes, sizes, and configurations. Additionally, while the disclosed embodiment shows only one pin/sliding member 48, multiple pins/sliding members 48 can be used such that first slotted connector 64 is not necessarily aligned with second slotted connector 66 and can be mechanically linked to lever 46 at a location that is remote from second slotted connector 66. As discussed above, each pin/sliding member 48 can have two sides that each extend respectively through first slotted connector 64 and second slotted connector 66 such that only one pin/sliding member 48 is needed to interact with both of first slotted connector 64 and second slotted connector 66.

Pivot 50 is a point about which lever 46 rotates between the spray position (in which pin 48 is rearward and finger 52 is upward) and the neutral, inactive position (in which pin 48 is forward and finger 52 is downward). Pivot 50 is located at a lower and rearward corner 50A of lever body 47 that is near the right angle of the generally right triangular member. Pivot 50 is formed by a bolt or another type of fastener that connects lever 46 to a member stationary relative to lever 46, such as gun holder 22. The fastener that attaches lever 46 to gun holder 22 should allow for lever 46 to rotate without a substantial amount of resistance. While pivot 50 is located at corner 50A of lever 46, pivot 50 can be located at another location that provides for rotation of lever 46 so that a rearward pull of pin 48 causes upward movement of finger 52.

Finger 52 (also referred to as a member attached to lever 46) is located at corner 52A of lever 46. Finger 46 is a member that extends out from a side of lever body 47 towards spray gun 20. Finger 46 extends outward from lever body 47 at a perpendicular angle, but in other embodiments can extend outward at another angle or have another configuration to engage trigger 56. Finger 52 is configured to move upward to engage trigger 56 of spray gun 20 (i.e., contact and push trigger 56 upward) to activate spray gun 20 when pin 48 is pulled rearward. Finger 52 is also configured to move downward into the neutral, inactive position to not engage trigger 56 when pin 48 is not being pulled rearward. The placement and orientation of finger 52 relative to spray gun 20 and gun holder 22 allows for spray gun 20 to be removed/detached from gun holder 22 without finger 52 engaging trigger 56. While finger 52 is shown as a cylindrical shaft, finger 52 can have other shapes, sizes, and configurations, but finger 52 should be long enough to be able to engage trigger 56. Finger 52 can be connected to lever body 47 of lever 46 by a bolt or another type of fastener.

First slotted connector 64 is connected to the first end of first cable 34. First slotted connector 64 can be crimped to the first end of first cable 34. First slotted connector 64 has elongated opening 65, which can have an eyelet shape, through which first side 49A of pin 48 extends. First slotted connector 64 is configured to pull pin 48 rearward to rotate lever 46 into the spray position when first slotted connector 64 is pulled rearward by first cable 34 (which is pulled rearward by manual control 8). Pin 48 is pulled rearward by first slotted connector 64 by coming into contact with a front side of first slotted connector 64 when first slotted connector 64 is pulled rearward by first cable 34. Pin 48 extends through first slotted connector 64 such that pin 48 is configured to slide within first slotted connector 64 when pin 48 is pulled rearward by second cable 36 (and second slotted connector 66). Pin 48 is allowed to slide rearward within first slotted connector 64 because pin 48 is not adjacent to or in contact with a rearward side of elongated opening 65 of first slotted connector 64 when pin 48 is in the neutral, inactive position. In other words, the shape of elongated opening 65 of first slotted connector 64 allows for significant travel of pin 48 within elongated opening 65 before contacting either the front side or the rearward side of elongated opening 65 of first slotted connector 64. Thus, pin 48 has space to slide rearward within elongated 65 opening of first slotted connector 64 without contacting and forcing first slotted connector 64 (and first cable 34) to move rearward. The front side and the rearward side of elongated opening 65 of first slotted connector 64 can be shaped to match the shape of pin 48 (i.e., rounded in the disclosed embodiment to match the rounded shape of pin 48), or elongated opening 65 can have another shape. A height of elongated opening 65 of first slotted connector 64 can be approximately equal to a height of pin 48, but elongated opening 65 should be sized and shaped to allow pin 48 to easily slide within first slotted connector 64. Besides first side 49A of pin 48 extending through and being able to be pulled by or slide within first slotted connector 64, first slotted connector 64 does not have a hard attachment to pin 48.

First cap 60 is adjacent to first slotted connector 64 and is connected to first side 49A of pin 48. First cap 60 prevents first slotted connector 64 from sliding off the end of first side 49A of pin 48 because first slotted connector 64, while being mechanically linked to pin 48, does not have a hard attachment to pin 48 and instead allows for pin 48 to slide within elongated opening 65 of first slotted connector 64. First cap 60 can have any configuration that allows for attachment to pin 48 and extension outward from pin 48 to prevent first slotted connector 64 from sliding off of the end of first side 49A of pin 48. Pin 48 can have a groove or other configuration that allows for attachment of first cap 60. Further, first cap 60 can be configured to be easily attachable and removable from pin 48 to allow for easy installation of first slotted connector 64 onto first side 49A of pin 48 during manufacture.

Second slotted connector 66 is very similar in configuration and functionality to first slotted connector 64. Second slotted connector 66 can be crimped to the first end of second cable 36. Second slotted connector 64 is connected to the first end of second cable 36. Second slotted connector 66 has elongated opening 67, which can have an eyelet shape, through which second side 49B of pin 48 extends and is configured to pull pin 48 rearward to rotate lever 46 into the spray position when second slotted connector 66 is pulled rearward from second cable 36 (which is pulled rearward by assisted control 10). Pin 48 is pulled rearward by second slotted connector 66 by coming into contact with a front side of second slotted connector 66 when second slotted connector 66 is pulled rearward by second cable 36. Pin 48 extends through second slotted connector 66 such that pin 48 is configured to slide within second slotted connector 66 when pin 48 is pulled rearward by first cable 34 (and first slotted connector 64). Pin 48 is allowed to slide rearward within second slotted connector 66 because pin 48 is not adjacent to or in contact with a rearward side of elongated opening 67 of second slotted connector 66 when pin 48 is in the neutral, inactive position. In other words, the shape of elongated opening 67 of second slotted connector 66 allows for significant travel of pin 48 within elongated opening 67 before contacting either the front side or the rearward side of elongated opening 67 of second slotted connector 66. Thus, pin 48 has space to slide rearward within elongated opening 67 of second slotted connector 66 without contacting and forcing second slotted connector 66 (and second cable 36) to move rearward. The front side and the rearward side of elongated opening 67 of second slotted connector 66 can be shaped to match the shape of pin 48 (i.e., rounded in the disclosed embodiment to match the rounded shape of pin 48), or elongated opening 67 can have another shape. A height of elongated opening 67 of second slotted connector 66 can be approximately equal to a height of pin 48, but elongated opening 67 should be sized and shaped to allow pin 48 to easily slide rearward within second slotted connector 66. Besides second side 49B of pin 48 extending through and being able to be pulled by or slide within second slotted connector 66, second slotted connector 66 does not have a hard attachment to pin 48.

Second cap 62 is very similar in configuration and functionality to first cap 60. Second cap 62 is adjacent to second slotted connector 66 and is connected to the end of second side 49B of pin 48. Second cap 62 prevents second slotted connector 66 from sliding off of the end of second side 49B of pin 48 because second slotted connector 66, while being mechanically linked to pin 48, does not have a hard attachment to pin 48 and instead allows for pin 48 to slide within elongated opening 67 of second slotted connector 66. Second cap 62 can have any configuration that allows for attachment to pin 48 and extension outward from pin 48 to prevent second slotted connector 66 from sliding off of the end of second side 49B of pin 48. Pin 48 can have a groove or other configuration that allows for attachment of second cap 62. Further, second cap 62 can be configured to be easily attachable and removable from pin 48 to allow for easy installation of second slotted connector 66 onto second side 49B of pin 48 during manufacture.

As shown in FIG. 2C, a distance from first slotted connector 64 on pin 48 to lever body 47 of lever 46 is greater than a distance from second slotted connector 66 on pin 48 to lever body 47 of lever 46. Also, due to the stair-step configuration of lever body 47 of lever 46, second slotted connector 66 and second cable 36 are substantially vertically aligned with the lower portion of lever 46. With second cable 36 and second slotted connector 66 being closer to lever body 47 and substantially vertically aligned with the lower portion of lever body 47 of lever 46, less force needs to be applied to second cable 36 by assisted control 10 to pull second cable 36 and pin 48 rearward (because less moment is created) to rotate lever 46 into the spray position to activate spray gun 20 (in comparison to the force that needs to be applied to first cable 34 by manual control 8). The reduction in force on second cable 36 reduces the wear on second cable 36, increasing the life cycle of second cable 36. Also, the reduction in force/power needed by assisted control 10 results in a reduction in the size of the components of assisted control 10, such as a plunger, solenoid, and spring that do not need to handle elevated forces and stresses. This reduces the weight of line striper 2. Further, because assisted control 10 has less power requirements, the gas engine, electric motor, or other power supply on line striper 2 can also be smaller, making line striper 2 more efficient. The disclosed embodiment shows first slotted connector 64 horizontally aligned with second slotted connector 66, but in other embodiments, first slotted connector 64 (and first cable 34) and second slotted connector 66 (and second cable 36) can be vertically aligned or otherwise in an over-under arrangement so as to be aligned with lever 46 such that first slotted connector 64 and second slotted connector 66 are coplanar with lever 46.

Because first cable 34 and second cable 36 are able to pull pin 48 rearward independently from one another, manual control 8 can control the application of paint by spray gun 20 independently from assisted control 10, and assisted control 10 can control the application of paint by spray gun 20 independently from manual control 8. This capability is advantageous when it is desired to apply paint manually while assisted control 10 is applying paint in a programmed pattern. The use of manual control 8 during a programmed pattern controlled by assisted control 10 does not affect the continuation of that programmed pattern, and the finishing of the application of paint manually by manual control 8 does not influence whether the programmed pattern continues or finishes.

Because pin 48 is able to slide within elongated opening 65 of first slotted connector 64 (when pulled rearward by second slotted connector 66) without causing first cable 34 from moving rearward, first cable 34 does not compress and bind when assisted control 10 activates spray gun 20 through the use of second cable 36. Binding of first cable 34 could cause damage to first cable 34 and/or manual control 8. The ability of pin 48 to slide within elongated opening 65 of first slotted connector 64 and elongated opening 67 of second slotted connector 66 prevents the cable not being used to activate spray gun 20 (either first cable 34 or second cable 36) from moving rearward and causing unneeded wear on the cable, manual control 8, and assisted control 10. Further, without the capability for pin 48 to move rearward without contacting and forcing first cable 34 to move rearward, a greater force would need to be applied by assisted control 10 to second cable 36 to move pin 48 rearward to overcome the resistance imparted on pin 48 by first cable 34. The greater force/power needed by assisted control 10 would result in larger components of assisted control 10 that are able to handle elevated forces and stresses. The greater force/power needed would also result in a larger power supply, such as a gas engine or electric motor, thus decreasing the efficiency of line striper 2. Similarly, the ability of pin 48 to slide within elongated opening 67 of second slotted connector 66 (when pulled rearward by first slotted connector 64) without causing second cable 36 from moving rearward ensures that second cable 36 does not compress and bind when manual control 8 activates spray gun 20 through the use of first cable 34. Binding on second cable 36 could cause damage to second cable 36 and/or assisted control 10. Without the capability for pin 48 to move rearward without contacting and forcing second cable 36 to move rearward, the force applied by a user to manual control 8 is reduced, making it easier on the user to manually activate spray gun 20.

First cable 34 and second cable 36 can be directly connected to pin/sliding member 48 or lever 46 such that first cable 34 and second cable 36 are in contact with pin/sliding member 48 or lever 46. In spray control system 32, first cable 34 and second cable 36 are mechanically linked to pin/sliding member 48 or lever 46. Parts which are mechanically linked can have one or more intermediary parts such that the two mechanically linked parts are not necessarily in contact with each other but movement of one part moves the other part. Thus, first cable 34 and second cable 36 are mechanically linked to pin/sliding member 48 but are not in contact with pin/sliding member 48 due to first slotted connector 64 and second slotted connector 66 being between the first cable 34 and pin 48 and between second cable 36 and pin 48, respectively.

Figure 3A:
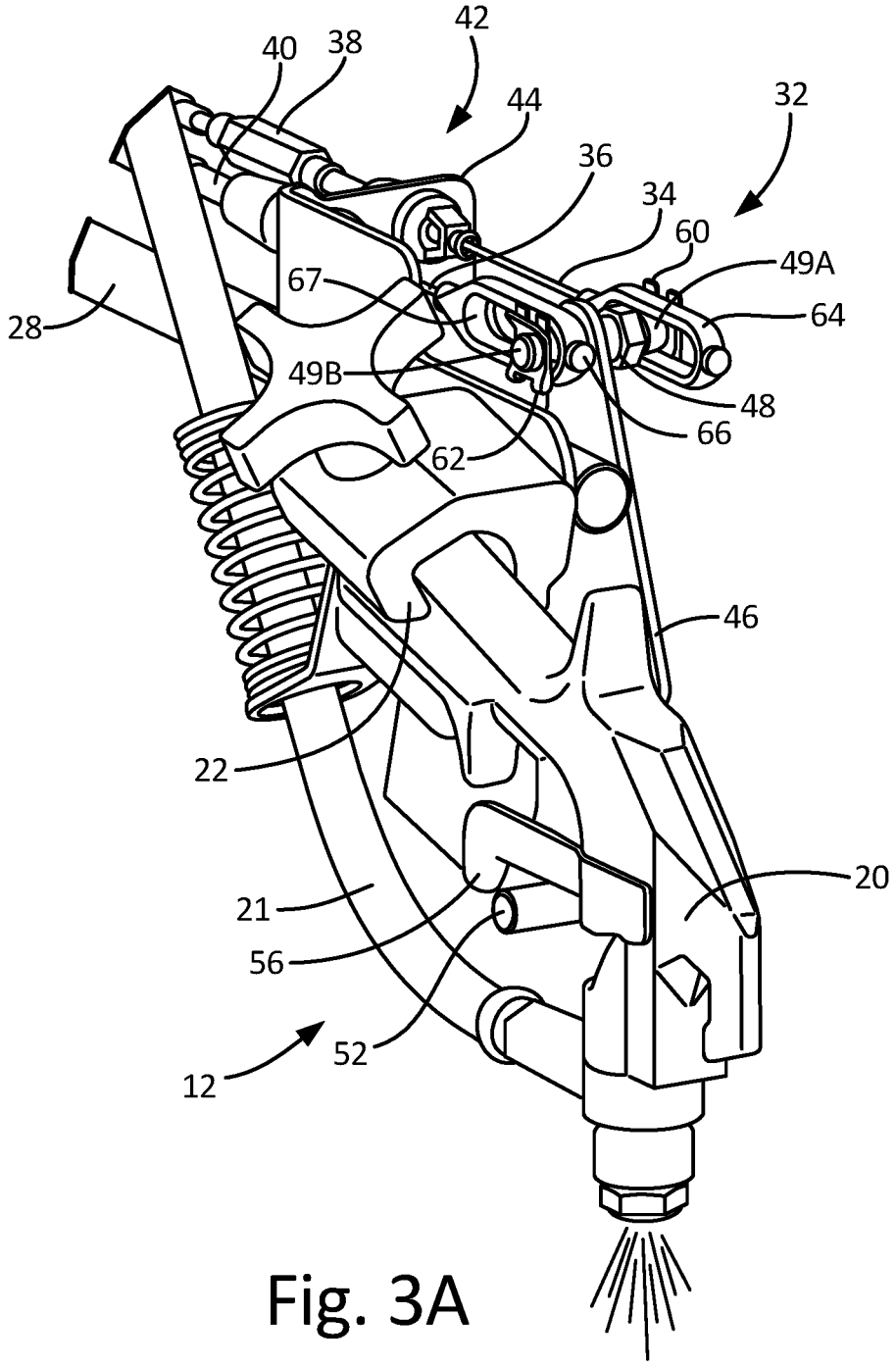
FIG. 3A is a front perspective view of the spray control system with the assisted control activating the spray gun.
Figure 3B:
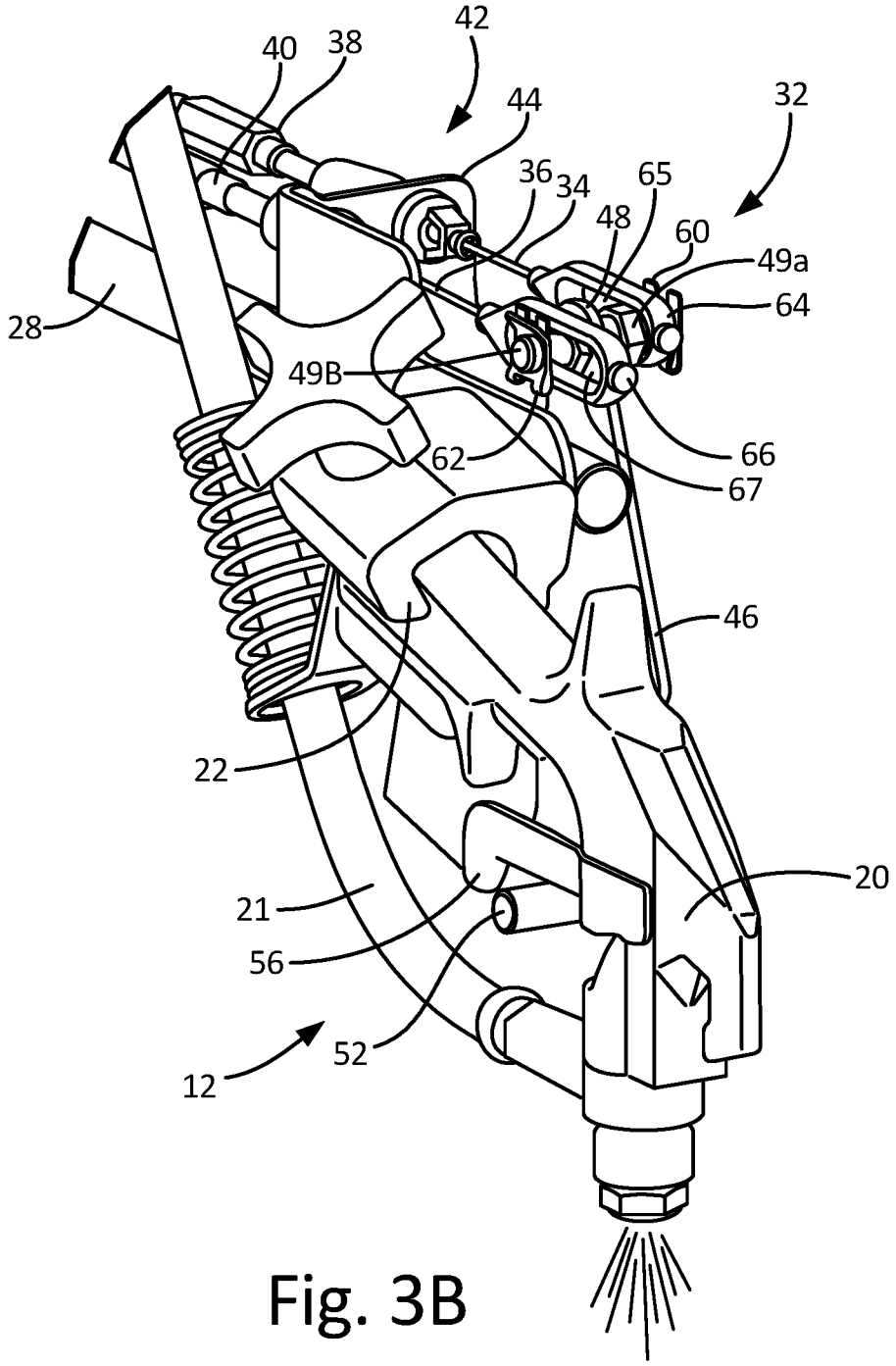
FIG. 3B is a front perspective view of the spray control system with the manual control activating the spray gun.

FIG. 3A is a front perspective view of a portion of spray control system 32 with assisted control 10 activating spray gun 20, and FIG. 3B is a front perspective view of a portion of spray control system 32 with manual control 8 activating spray gun 20. Gun assembly 12 includes spray gun 20 with trigger 56, hose 21, gun holder 22, and extension bar 28. Spray control system includes manual control 8 (not shown), assisted control 10 (not shown), first cable 34, second cable 36, first sheath 38, second sheath 40, cable junction 42, bracket 44, lever 46 (having lever body 47, pin 48, pivot 50 (not shown), and finger 52), first cap 60, second cap 62, first slotted connector 64, second slotted connector 66, and resilient member 68.

Figure 4:
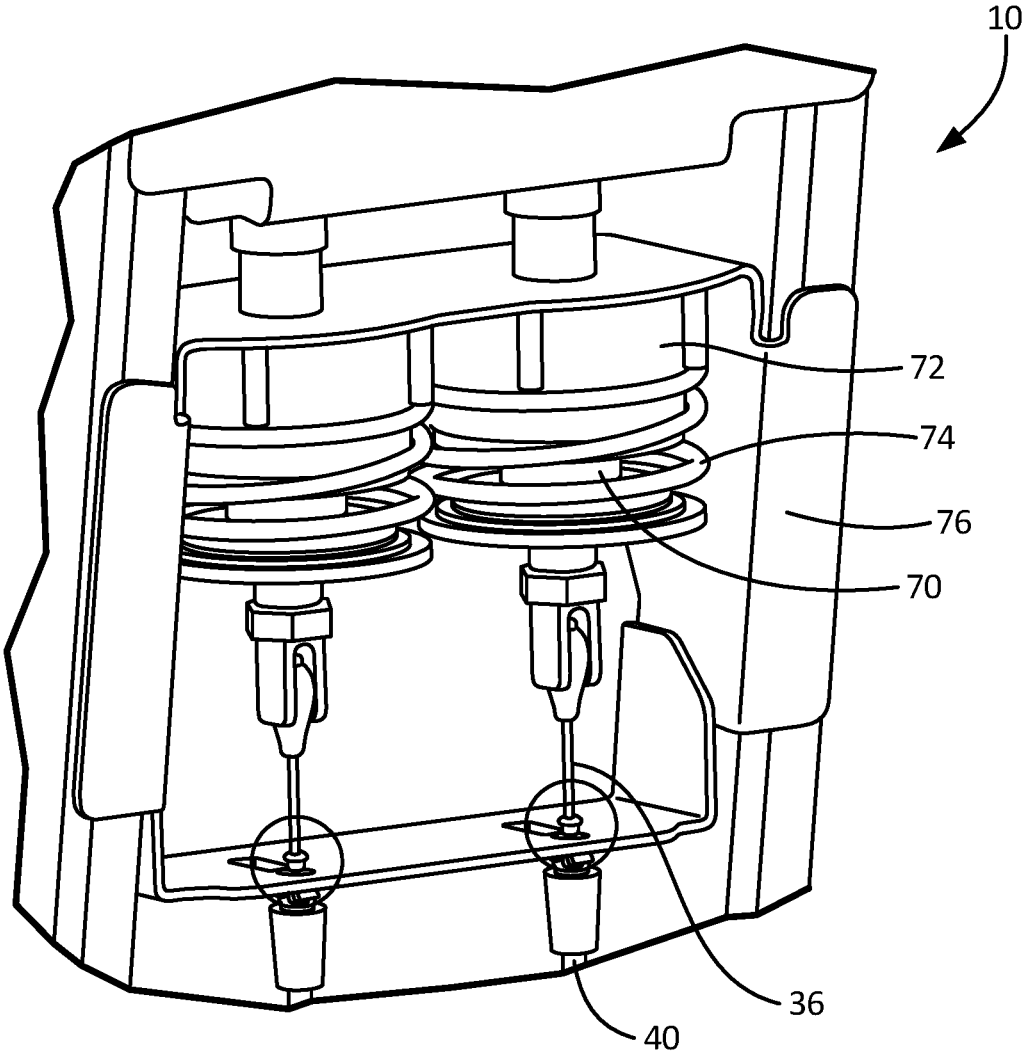
FIG. 4 is a perspective view of an assisted control.

Spray control system 32 as shown in FIG. 3A shows assisted control 10 activating spray gun 20 by pulling second cable 36 rearward (the components of assisted control 10 are described in greater detail with regards to FIG. 4). Second cable 36 being pulled rearward causes second slotted connector 66 to move rearward such that the front side of elongated opening 67 in second slotted connector 66 contacts and pulls pin 48 rearward. With pin 48 being pulled rearward, lever 46 rotates about pivot 50 (not viewable in the perspective view of FIGS. 3A-3B), which in turn causes finger 52 to move upward to engage/contact and push trigger 56 into the spray position to activate spray gun 20. As shown in FIG. 3A, pin 48 is closer to the rearward side of elongated opening 65 of first slotted connector 64 (because pin 48 is being pulled rearward by second slotted connector 66), but pin 48 is not contacting the rearward side of first slotted connector 64. Due to the shape of elongated opening 65 in first slotted connector 64 and the space between pin 48 and the rearward side of first slotted connector 64 when pin 48 is in the neutral, inactive position, pin 48 is able to slide rearward within elongated opening 65 of first slotted connector 64 without moving or otherwise affecting first slotted connector 64 and first cable 34 (i.e., first slotted connector 64 remains stationary while pin 48 is able to slide within elongated opening 65 of first slotted connector 64). If pin 48 were to engage the rearward side of elongated opening 65 of first slotted connector 64 (e.g., in the case that first slotted connector 64 merely had a hole the size of pin 48 instead of an elongated opening), then the movement of second slotted connector 66 would translate through pin 48 to also move first slotted connector 64 and compress first cable 34. Being that first cable 34 is not necessarily in tension, but rather is in the neutral, inactive position, first cable 34 may bind and/or push back against manual control 8.

Figure 5:
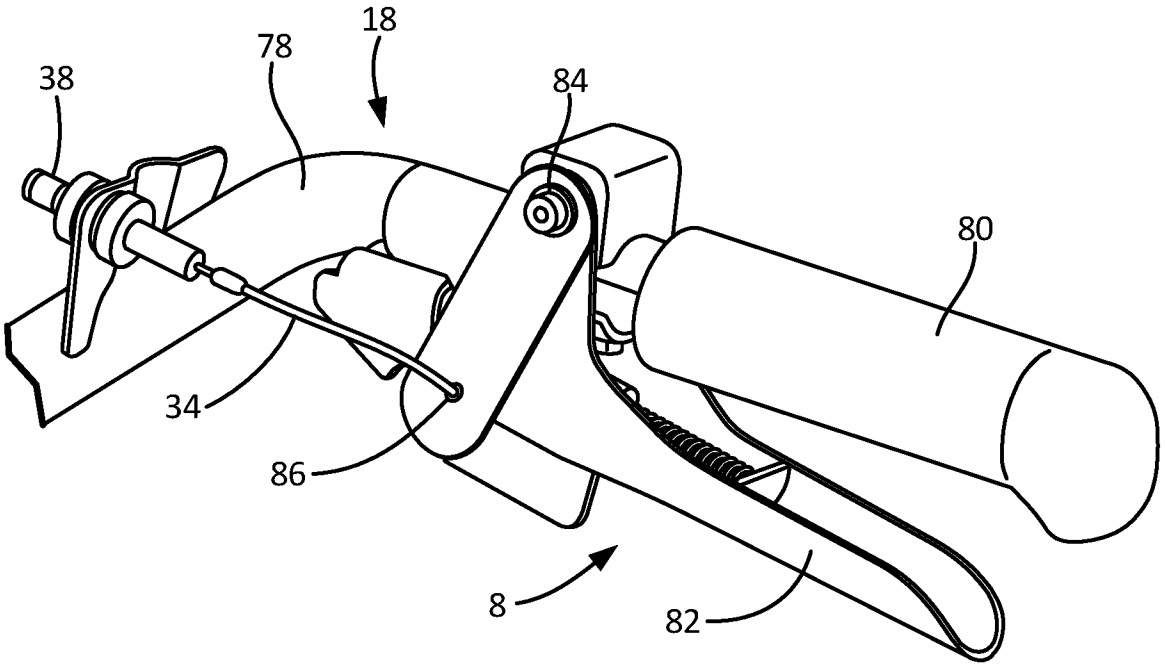
FIG. 5 is a perspective view of a manual control.

Spray control system 32 as shown in FIG. 3B shows manual control 8 activating spray gun 20 by pulling first cable 34 rearward (the components of manual control 8 are described in greater detail with regards to FIG. 5). First cable 34 being pulled rearward causes first slotted connector 64 to move rearward such that the front side of elongated opening 65 in first slotted connector 64 contacts and pulls pin 48 rearward. With pin 48 being pulled rearward, lever 46 rotates about pivot 50 (not viewable in the perspective view of FIGS. 3A-3B), which in turn causes finger 52 to move upward to engage/contact and push trigger 56 into the spray position to activate spray gun 20. As shown in FIG. 3B, pin 48 is closer to the rearward side of elongated opening 67 of second slotted connector 66 (because pin 48 is being pulled rearward by first slotted connector 64), but pin 48 is not contacting the rearward side of second slotted connector 66. Due to the shape of elongated opening 67 in second slotted connector 66 and the space between pin 48 and the rearward side of second slotted connector 66 when pin 48 is in the neutral, inactive position, pin 48 is able to slide rearward within elongated opening 67 of second slotted connector 66 without moving or otherwise affecting second slotted connector 66 and second cable 36 (i.e., second slotted connector 66 remains stationary while pin 48 is able to slide within elongated opening 67 of second slotted connector 66). If pin 48 were to engage the rearward side of elongated opening 67 of second slotted connector 66 (e.g., in the case that second slotted connector 66 merely had a hole the size of pin 48 instead of an elongated opening), then the movement of first slotted connector 64 would translate through pin 48 to also move second slotted connector 66 and compress second cable 36. Being that second cable 36 is not necessarily in tension, but rather is in the neutral, inactive position, second cable 36 may bind and/or push back against assisted control 10.

The configuration of spray control system 32 allows for first cable 34 and second cable 36 to both pull on pin 48 of lever 46 while not interfering with each other, which reduces the force needed to pull each cable by not requiring or otherwise having to overcome the other cable. Lever 46 is independently moveable relative to first cable 34 and second cable 36 such that movement of lever 46 from the inactive position to the active position caused by pulling of first cable 34 does not compress second cable 36, and movement of lever 46 from the inactive position to the active position caused by pulling of second cable 36 does not compress first cable 34. In other embodiments, first cable 34 and second cable 36 can be separate from one another so as to be at different locations on line striper 2, such as near operator station 18. One such embodiment is described in regards to FIG. 6.

FIG. 4 is a perspective view of a portion of assisted control 10. Assisted control 10 includes a controller on operator station 18 (shown in FIG. 1), plunger 70, solenoid 72, spring 74, and casing 76. Second cable 36 is connected to plunger 70, and second sheath 40 surrounds second cable 36. Assisted control 10 as shown in FIG. 4 can be located below operator station 18 near the rear of line striper 2, amongst other options.

Assisted control 10 can include a controller on operator station 18 (shown in FIG. 1) that can include input buttons, a display, and one or multiple computer processors that allow a user to select a desired preprogrammed spray pattern or create a non-preprogrammed spray pattern. For example, the controller (or other circuitry of line striper 2) may include a preprogrammed pattern that sprays dashed stripes of predetermined lengths. A distance of each dashed stripe can be determined, for the purpose of spraying a particular line length, by a mechanism attached to one or more wheels of line striper 2, by a GPS or another positioning system, or by another means.

The controller is connected to and instructs solenoid 72 to pull on plunger 70. Solenoid 72 is a common solenoid based on electrical activity that is understood by one of skill in the art. While assisted control 10 is shown to use solenoid 72, other embodiments can include other means of driving a pull of second cable 36, such as through the use of hydraulics.

Plunger 70 is as least partially within solenoid 72 and is pulled upward within solenoid 72 when solenoid 72 is activated. A first, upper end of plunger 70 is attached to solenoid 72, while a second, lower end of plunger 70 is attached to the second end of second cable 36. Plunger 70 can have a variety of configurations and be constructed from a variety of materials, but plunger 70 should be configured to move upward into the spray position when pulled by solenoid 72. The upward movement of plunger 70 causes the second end of second cable 36 to move upward, which in turn pulls on the first end of second cable 36 to pull pin 48 rearward to activate spray gun 20. Plunger 70 should also be configured to move downward into the neutral, inactive position when not being pulled by solenoid 72 to allow the second end of second cable 36 to return to the neutral, inactive position, which in turn allows the first end of second cable 36 and pin 48 to move forward into the neutral, inactive position.

Spring 74 is a resilient member adjacent to plunger 70 that biases plunger 70 downward such that plunger 70 and second cable 36 are in a downward position when not being pulled upward by solenoid 70. While spring 74 is shown in FIG. 4 as a helical spring, spring 74 can be any resilient member configured to pull or push plunger 70 downward. Further, an embodiment of spray control system 32 may include a configuration that does not include spring 74.

It is noted that solenoid 72 and plunger 70 have a vertical orientation such that plunger 70 moves upward and downward. The upward motion of plunger 70 caused by solenoid 72 overcomes the force of gravity on plunger 70 and the downward biasing force caused by spring 74. Spring 74 can serve to return plunger 70 back to the neutral, inactive position after activation of solenoid 72 causes plunger 70 to move upward. As shown in FIG. 4, spring 74 does not resist the travel of plunger 70 for an initial portion of an upward stroke, but then engages and resists the travel of plunger 70 for the remaining portion of the upward stroke. Solenoid 72 may have an initial weak force on plunger 70 but the force may increase as plunger 70 travels further upward into solenoid 72. Therefore, to minimize the power delivered/needed by solenoid 72, it may be preferable to have plunger 70 not retrained by spring 74 for the initial portion of the upward stroke (i.e., the initial movement upward by plunger 70) but then have spring 74 engage plunger 70 for the remaining portion of the upward stroke (i.e., the remaining upward movement by plunger 70) when the electromagnetic force acting on plunger 70 is greater. Because solenoid 72 and plunger 70 are in a vertical orientation, gravity supplies the return force for a first portion of a downward stroke and gravity and spring 74 supply the return forces for the remaining portion of the downward stroke.

Casing 76 surrounds plunger 70, solenoid 72, spring 74, and the second end of second cable 36 to provide structural support and protection to those components. As shown in FIG. 4, line striper 2 can include more than one assisted control 10, which can control the application of paint by more than one spray gun 20. The controller or other mechanism can have the capability to control multiple assisted controls 10 and multiple spray guns 20 to apply complex line patterns involving more than one spray gun 20.

Once the spray pattern is selected by the user, the controller, or by other means, the controller instructs the activation of solenoid 72. When solenoid 72 is activated, solenoid 72 pulls plunger 70 upward, which in turn pulls the second end of second cable 36 upward (which pulls the first end of second cable 36 rearward) to activate spray gun 20. When the programmed pattern calls for a period in which paint is to not be applied, the controller instructs the deactivation of solenoid 72, which then does not pull on plunger 70. When plunger 70 is not being pulled upward by solenoid 72, plunger 70 is urged downward into the neutral, inactive position by gravity and spring 74, which in turn allows second cable 36 to return to the neutral, inactive position where second cable 36 is not being pulled upward and spray gun 20 is not being activated.

The ability for assisted control 10 to electronically activate spray gun 20 and manual control 8 to manually activate spray gun 20 as desired by a user and without the need to make any adjustments to line striper 2 gives the user flexibility for operating line striper 2 at a job site without wasted downtime. FIG. 4 shows only one embodiment of assisted control 10, and assisted control 10 can include other configurations that function to pull second cable 36 rearward to rotate lever 46 into the spray position.

FIG. 5 is a perspective view of manual control 8, which can be an actuator located as part of or near operator station 18. FIG. 5 shows a portion of operator station 18, which includes handlebar 78 and grip 80. Manual control 8 includes handle 82 that rotates about pivot point 84 and connects to the second end of first cable 34 at connection point 86. Surrounding first cable 34 is first sheath 38. Manual control 8 is configured to allow a user of line striper 2 to activate spray gun 20 remotely from the rear of line striper 2, such as from operator station 18. To pull on trigger 56 to activate spray gun 20, manual control 8 pulls the second end of first cable 34, which in turn pulls the first end of first cable 34 rearward to pull pin 48 rearward to activate spray gun 20. Manual control 8 pulls on the second end of first cable 34 through the use of handle 82 located on handlebar 78 of operator station 18 near grip 80.

Handlebar 78 is located at the rear of line striper 2 and is part of operator station 18. Handlebar 78 includes grip 80 at an end to allow for a location where a user of line striper 2 can place his/her hand to control the direction, forward and rearward motion, and other movements and functions of line striper 2.

Handle 82 is a lever adjacent to grip 80 that rotates about pivot point 84, which is located on handlebar 78. The second end of first cable 34 connects to handle 82 at connection point 86, which is positioned such that rotation of handle 82 causes connection point 86 to move, which in turn causes first cable 34 to move. To pull first cable 34, handle 82 is rotated by the user into a position in which an end of handle 82 distant from connection point 86 is adjacent to grip 80, thereby causing connection point 86 to move towards a tip of grip 80 and in turn causing first cable 34 to move towards the tip of grip 80 (i.e., to the right in FIG. 5). To move first cable 34 into the neutral, inactive position, a user releases or otherwise allows handle 82 to rotate away from grip 80 to the neutral position in which handle 82 is distant from the tip of grip 80. The rotation of handle 82 back into the neutral position causes connection point 86 to move toward an angled part of handlebar 78, which in turn causes first cable 34 to move away from the tip of grip 80 and in the forward direction (i.e., to the left in FIG. 5). First cable 34 and handle 82 are biased towards this forward, neutral position by resilient member 68 near the first end of first cable 34, which pushes on the first end of cable 34 to ensure first cable 34 remains in the neutral, inactive position when first cable 34 is not being pulled rearward by manual control 8. In another configuration, manual control 8 can include biasing means, such as a spring, that biases handle 82 into the neutral position. FIG. 5 shows only one embodiment of manual control 8, and manual control 8 can include other configurations that function to pull first cable 34 rearward to rotate lever 46 into the spray position.

Manual control 8 allows a user to manually actuate to control the application of paint by spray gun 20 from operator station 18 by allowing the user to rotate handle 82 into a position in which first cable 34 is pulled rearward, which in turn pulls pin 48 rearward to rotate lever 46 into the spray position that pushes trigger 56 to activate spray gun 20. As described previously, the movement of first cable 34 rearward does not affect the movement of second cable 36, and pin 48 can be pulled rearward by first cable 34 independent from the movement of second cable 36. Alternatively, the movement of second cable 36 rearward does not affect the movement of first cable 34, and pin 48 can be pulled rearward by second cable 34 independent from the movement of first cable 34.

Figure 6:
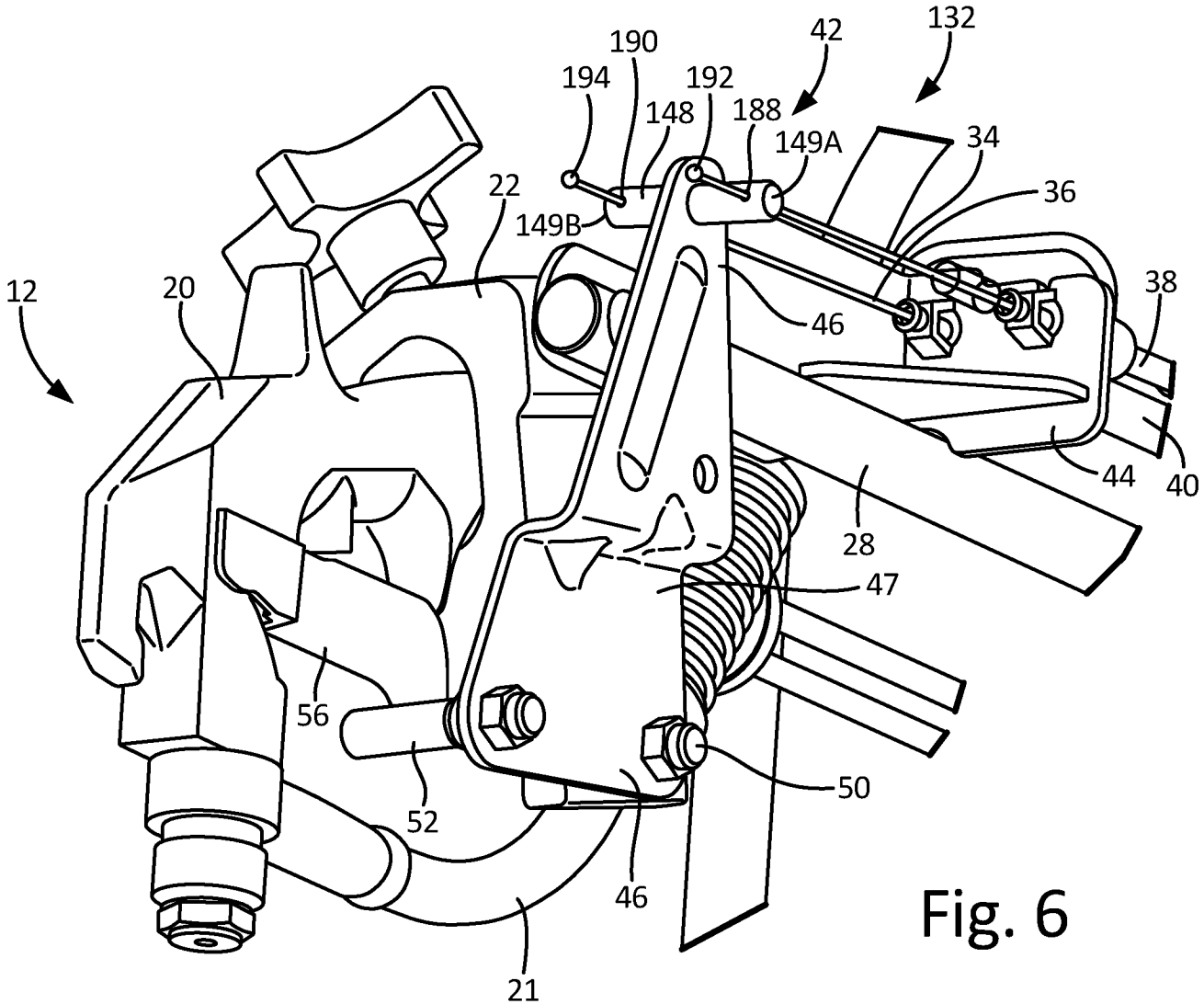
FIG. 6 is a front perspective view of another embodiment of a spray control system.

FIG. 6 is a front perspective view of a portion of gun assembly 12 and a portion of another embodiment of spray control system 132. Similarly to the previously described embodiment shown in FIG. 2B, the components of gun assembly 12 shown are gun 20, hose 21, gun holder 22, and extension bar 28. Spray control system 132 includes the same components and functionality of spray control system 32 shown in FIGS. 1-5, except that spray control system 132 does not include first slotted connector 64, second slotted connector 66, first cap 60, and second cap 62. Rather, first cable 34 and second cable 36 are in contact with lever 46 of spray control system 132 through first aperture 188 and second aperture 190 in pin 148. First cable 34 includes first stopper 192, and second cable 36 includes second stopper 194. With first cable 34 and second cable 36 in contact with lever 46 (i.e., in contact with pin 148), first cable 34 and second cable 36 are directly connected to pin 148. As with the previous embodiment, pin 148 is just one example of a sliding member.

In spray control system 132, pin 148 of lever 46 includes first aperture 188 extending horizontally through first side 149A of pin 148. First aperture 188 is a hole through which first cable 34 is able to extend and slide. A location of first aperture 188 in pin 148 can align with a point at which first cable 34 extends through bracket 44. A diameter of first aperture 188 should be large enough to allow first cable 34 to slide within easily without causing a great amount of resistance. Pin 148 of lever 46 also includes second aperture 190 extending horizontally through second side 149B of pin 148. Second aperture 190 is a hole through which second cable 36 is able to extend and slide. A location of second aperture 190 in pin 148 can align with a point at which second cable 36 extends through bracket 44. A diameter of second aperture 190 should be large enough to allow second cable 34 to slide within easily without causing a great amount of resistance.

First stopper 192 is attached to the first end of first cable 34 to prevent the first end of first cable 34 from being pulled through and disconnected from pin 148. First stopper 192 can be any member configured to have a secure connection to first cable 34 and transfer rearward movement of first cable 34 into rearward movement of pin 148 to rotate lever 46 to activate spray gun 20. First stopper 192 can have any size, shape, or configuration, but should be larger than the diameter of first aperture 188 so that first stopper 192 cannot be pulled into first aperture 188 to become lodged within first aperture 188 or to be pulled clear through first aperture 188 to allow first cable 34 to become disconnected from pin 148. When first cable 34 is pulled rearward by manual control 8, the first end of first cable 34 moves rearward, which in turn causes first stopper 192 to move rearward and directly contact pin 148 to pull pin 148 rearward.

Second stopper 194 is attached to the first end of second cable 34 to prevent the first end of second cable 36 from being pulled through and disconnected from pin 148. Second stopper 194 can be any member configured to have a secure connection to second cable 36 and transfer rearward movement of second cable 34 into rearward movement of pin 148 to rotate lever 46 to activate spray gun 20. Second stopper 194 can have any size, shape, or configuration, but should be larger than the diameter of second aperture 190 so that second stopper 194 cannot be pulled into second aperture 190 to become lodged within second aperture 190 or to be pulled clear through first aperture 188 to allow second cable 36 to become disconnected from pin 148. When second cable 36 is pulled rearward by assisted control 10, the first end of second cable 36 moves rearward, which in turn causes second stopper 194 to move rearward and directly contact pin 148 to pull pin 148 rearward.

With first cable 34 and second cable 36 able to slide within first aperture 188 and second aperture 190, respectively, the rearward movement of pin 148 as caused by first cable 34 does not cause second cable 36 to move rearward. Additionally, the rearward movement of pin 148 as caused by second cable 36 does not cause first cable 34 to move rearward. However, the addition of first stopper 192 on first cable 34 and second stopper 194 on second cable 36 allow for first cable 34 and second cable 36 to pull pin 148 rearward independent from one another when prompted by manual control 8 or assisted control 10, respectively. In other words, lever 46 is independently moveable relative to first cable 34 and second cable 36 such that movement of lever 46 from the inactive position to the active position caused by pulling of first cable 34 does not compress second cable 36, and movement of lever 46 from the inactive position to the active position caused by pulling of second cable 36 does not compress first cable 34.

Figure 7:
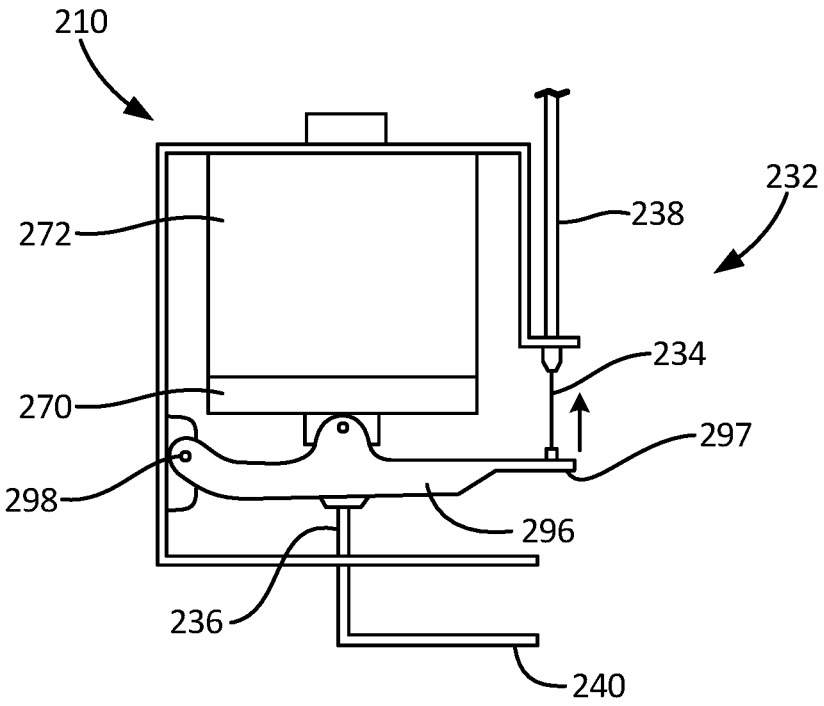
FIG. 7 is a cross section elevation view of a portion of another embodiment of a spray control system.

FIG. 7 is a cross section elevation view of a portion of another embodiment of spray control system 232. Spray control system 232 includes a manual control (not shown, but similar to manual control 8), assisted control 210, first cable 234, second cable 236, first sheath 238, second sheath 240, and activation arm 296. Assisted control 210 includes a controller (not shown, but similar to the controller described in regards to assisted control 10), plunger 270, and solenoid 272. Activation arm 296 includes connection point 297 and pivot point 298.

Spray control system 232 provides for a configuration in which only one cable runs from a point near assisted control 210 at a rear of line striper 2 to the front to mechanically link to pin 48 of lever 46. The forward components of spray control system 232 are the same as with spray control system 32 and spray control system 132, except that only one cable, second cable 236, extends forward to mechanically link to pin 48. However, while only having second cable 236 mechanically linked to and able to pull pin 48 rearward to rotate lever 46 to activate spray gun 20, spray control system 232 is still able to accommodate the dual use of a manual control and assisted control 210.

Spray control system 232 includes activation arm 296, which is a rigid member located between plunger 270 and second cable 236. Activation arm 296 is attached at pivot point 298 to a casing or other stationary member. Activation arm 296 rotates about pivot point 298. At an end distal from pivot point 298, activation arm 296 is attached to first cable 234 at connection point 297. At a point along activation arm 296, a second end of second cable 236 is attached to a bottom side of activation arm 296 (with a first end of second cable 236 being connected to pin 46). Plunger 270 is attached to a top side of activation arm 296. Activation arm 296 can have a variety of configurations and be constructed from a variety of materials, including metal (such as aluminum), a metal alloy, a composite, or another material. However, activation arm 296 should be configured to transfer force from plunger 270 to second cable 236 and force from first cable 234 to second cable 236.

Assisted control 210 has a similar configuration and functionality as assisted control 10 as described with regards to FIG. 4, except that activation arm 296 is between plunger 270 and the second end of second cable 236. Assisted control 210 can include a controller that is attached to and instructs solenoid 72 to actuate to pull on plunger 270. When solenoid 272 is activated, solenoid 272 pulls plunger 270 upward, which in turn pulls activation arm 296 upward. With the second end of second cable 236 being connected to activation arm 296, upward movement of activation arm 296 as caused by plunger 270 causes second cable 236 to move upward, which in turn causes a first end of second cable 236 to move rearward to pull on pin 48 to rotate lever 46 to activate spray gun 20. When solenoid 272 is deactivated, gravity or a resilient member (such as spring 74 in assisted control 8) causes plunger 270 to move downward into a neutral, inactive position in which activation arm 296 and the second end of cable 236 are in a downward position.

Spray control system 232 includes first cable 234, which is connected at a first end to activation arm 296 at connection point 297 and is connected at a second end to a manual control (such as manual control 8 in FIG. 5). To manually activate spray gun 20, the manual control would pull first cable 234 upward, which in turn would cause activation arm 296 to move upward at connection point 297. An upward movement of activation arm 296 at connection point 297 causes activation arm 296 to rotate about pivot point 298 and causes the second end of second cable 236 to move upward, which in turn causes rearward movement of the first end of second cable 236 to pull pin 48 rearward to rotate lever 46 to activate spray gun 20.

With the upward movement of activation arm 296 (i.e., rotation of activation arm 296 about pivot point 298), which causes upward movement of second cable 236, activation arm 296 is able to be controlled by both assisted control 210 and the manual control. Thus, spray control system 232 has the capability to both have assisted/automated control (i.e., activation of spray gun 20 by a controller with a programmed line striping pattern) and manual control (i.e., a user decides when to activate spray gun 20 to apply paint). Spray control system 232 only requires one cable (second cable 236) to run from activation arm 296, which can be located near operator station 18, to pin 48 on gun assembly 12.

Spray control system 32 for controlling spray gun 20 on line striper 2 is disclosed. Spray control system 32 includes spray gun 20 with trigger 56 moveable between a spray position and a neutral, inactive position. Spray gun 20 is able to be detached from line striper 2 to apply paint distant from line striper 2 and is able to be attached to line striper 2 adjacent to lever 46 by gun holder 22. Lever 46 is configured to move between the spray position and the inactive position. Lever 46 has lever body 47 with pin 48 extending from a first end and finger 52 extending from a second end adjacent to trigger 56 on spray gun 20 to engage trigger 56 when in the spray position and not engage trigger 56 when in the inactive position. First cable 34 is mechanically linked to first side 49A of pin 48, and second cable 36 is mechanically linked to second side 49B of pin 48. First cable 34 is mechanically linked to manual control 8, which is configured to allow a user to pull first cable 34 rearward to rotate lever 46 into the spray position to activate spray gun 20. Second cable 36 is mechanically linked to assisted control 10, which is configured to pull second cable 36 rearward when instructed to rotate lever 46 into the spray position to activate spray gun 20. The mechanical linkage between first cable 34 and pin 48 of lever 46 and second cable 36 and pin 48 of lever 46 is configured such that the rearward pull of pin 48 by first cable 34 does not pull second cable 36 rearward, and the rearward pull of pin 48 by second cable 36 does not pull first cable 34 rearward.

First cable 34 and second cable 36 can be mechanically linked to 48 pin of lever 46 through a number of different configurations. Pin 148 of lever 48 can include first aperture 188 and second aperture 190 through which first cable 34 and second cable 36 extend and are able to slide. Each of first cable 34 and second cable 36 can include first stopper 192 and second stopper 194 on an end such that each cable 34, 36 and stopper 192, 194 are able to pull pin 148 rearward into the spray position without influencing/moving the other cable 34, 36. First cable 34 and second cable 36 can be connected to pin 48 of lever 46 through the use of first slotted connector 64 and second slotted connector 66. Each slotted connector 64, 66 is connected to an end of a respective cable 34, 36 and has elongated opening 65, 67 through which a side of pin 48 extends. Each slotted connector 64, 66 is configured to pull pin 48 rearward into the spray position when pulled rearward by the respective cable 34, 36. Each slotted connector 64, 66 is also configured to allow pin 48 to slide within elongated opening 65, 67 when pin 48 is being pulled rearward by the other cable 34, 36, thus allowing one cable 34, 36 to pull pin 48 rearward without causing the other cable 34, 36 to move rearward. These are just two examples of a configuration that allows first cable 34 and second cable 36 to pull pin 48 of lever 48 rearward independently from one another without causing the other cable 34, 36 to move rearward, compress, and bind, which can cause damage to the cable 34, 36. Further, spray control system 32, 132, 232 allows assisted control 10, 210, which is mechanically linked to second cable 36 and controls the rearward movement of second cable 36, to have a decreased requirement for power to pull second cable 36 rearward. Assisted control 10, 210 does not need a large amount of power to pull second cable 36 rearward because assisted control 10, 210 only needs enough power to pull second cable 36 and does not need to overcome the resistance caused by the pulling/binding of first cable 34. This reduction in power needed by assisted control 10, 210 allows for line striper 2 to be more efficient by reducing the size of the components of assisted control 10, 210, the power supply to assisted control 10, 210, and the weight of the power supply.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. As one example, an embodiment relying on an electric motor is described, but the features discussed herein could also be used with a gas motor and/or hydraulic drive.

The invention claimed is:

1. A line striper having a spray control system, the line striper comprising:

a wheeled line striper having a spray gun;

a lever configured to move between a spray position where the lever causes the spray gun to spray and an inactive position where the lever does not cause the spray gun to spray, the lever including a first pin extending from a first side of the lever and a second pin extending from a second side of the lever;

a first cable having a first end and a second end with the first end of the first cable mechanically linked to the first pin such that when the first cable is pulled, the first end of the first cable moves in a first direction to pull the lever;

a first actuator mechanically linked to the second end of the first cable, the first actuator configured to pull the first cable to move the lever into the spray position;

a second cable having a first end and a second end with the first end of the second cable mechanically linked to the second pin such that when the second cable is pulled, the first end of the second cable moves in the first direction to pull the lever; and a second actuator mechanically linked to the second end of the second cable, the second actuator configured to pull the second cable to move the lever into the spray position, wherein one of the first actuator and the second actuator is connected to an electronic spray control system configured to electrically actuate one of the first actuator and the second actuator, wherein the lever is independently moveable relative to the first cable and the second cable.

2. The line striper of claim 1, wherein the first end of the first cable is connected to the first pin and the first end of the second cable is connected to the second pin.

3. The line striper of claim 1, wherein the lever is rotatable about a pivot between the spray position and the inactive position.

4. The line striper of claim 1, wherein the first pin includes a first aperture through which the first cable extends and the second pin includes a second aperture through which the second cable extends such that movement of the lever from the inactive position to the active position does not compress the first cable and the second cable.

5. The line striper of claim 1, wherein the lever includes a member attached to the lever, the member positioned adjacent a trigger of the spray gun to engage and move the trigger when the lever moves from the inactive position to the spray position.

6. The line striper of claim 5, wherein the member does not engage the trigger when the lever moves from the spray position to the inactive position.

7. The line striper of claim 1, further comprising:

a resilient member near the first end of the first cable to bias the first cable towards the inactive position.

8. The line striper of claim 1, wherein the manual actuator comprises:

a handle directly connected to the second end of the first cable, the handle configured to rotate about a point to pull the first cable.

9. The line striper of claim 1, wherein the electronic spray control system is connected to the second actuator, the line striper further comprising:

a plunger mechanically linked to the second end of the second cable;

a solenoid adjacent to the plunger, the solenoid configured to move the plunger when activated;

a controller configured to activate the solenoid to move the plunger to pull the second cable into the spray position; and a resilient member adjacent to the plunger to bias the plunger towards the inactive position.

10. The line striper of claim 1, further comprising:

a gun holder configured to hold the spray gun adjacent to the lever.

11. The line striper of claim 1, wherein the first actuator is a manual actuator, the line striper further comprising:

an operator station, wherein the first cable extends from the operator station to the lever.

12. The line striper of claim 1, further comprising:

a bracket adjacent to and providing support to the first end of the first cable and the first end of the second cable.

13. A line striper having a spray control system, the line striper comprising:

a wheeled line striper having a spray gun;

a lever configured to move between a spray position where the lever causes the spray gun to spray and an inactive position where the lever does not cause the spray gun to spray, the lever including at least one sliding member extending from the lever;

a first cable having a first end and a second end with the first end of the first cable mechanically linked to one of the at least one sliding member of the lever;

a manual actuator mechanically linked to the second end of the first cable, the manual actuator configured to pull the first cable to move the lever into the spray position;

a second cable having a first end and a second end with the first end of the second cable mechanically linked to one of the at least one sliding member of the lever;

an electronic spray control system mechanically linked to the second end of the second cable, the electronic spray control system configured to pull the second cable to move the lever into the spray position;

a first slotted connector linked to the first end of the first cable and having an opening through which one of the at least one sliding member extends, the first slotted connector being configured to pull one of the at least one sliding member to move the lever into the spray position when pulled by the first cable and configured to allow one of the at least one sliding member to slide within the opening when one of the at least one sliding member is being pulled by the second cable; and a second slotted connector linked to the first end of the second cable and having an opening through which one of the at least one sliding member extends, the second slotted connector being configured to pull one of the at least one sliding member to move the lever into the spray position when pulled by the second cable and configured to allow one of the at least one sliding member to slide within the opening when one of the at least one sliding member is being pulled by the first cable.

14. The line striper of claim 13, wherein the at least one sliding member comprises only one sliding member that extends through both openings of the first and second slotted connectors.

15. The line striper of claim 13, wherein the lever comprises a first side and a second side opposite the first side and wherein the first slotted connector is located on the first side of the lever and the second slotted connector is located on the second side of the lever.

16. The line striper of claim 14, wherein the sliding member comprises a pin.

17. A line striper having a spray control system, the line striper comprising:

a wheeled line striper having a spray gun;

a lever configured to move between a spray position where the lever causes the spray gun to spray and an inactive position where the lever does not cause the spray gun to spray, the lever having a member at one end;

a first cable having a first end and a second end with the first end of the first cable mechanically linked to the lever;

a manual actuator mechanically linked to the second end of the first cable, the manual actuator configured to pull the first cable rearward to move the lever into the spray position;

a second cable having a first end and a second end with the first end of the second cable mechanically linked to the lever;

an electronic spray actuator mechanically linked to the second end of the second cable, the electronic spray actuator configured to pull the second cable to move the lever into the spray position;

a first connector linked to the first end of the first cable and having an opening within which the member can move, the first connector being configured to pull the lever to move the lever into the spray position when pulled by the first cable and configured to allow at least a portion of the lever to slide within the opening when the lever is being pulled by the second cable; and a second connector linked to the first end of the second cable and having an opening within which the member can move, the second connector being configured to pull the lever to move the lever into the spray position when pulled by the second cable and configured to allow at least a portion of the lever to slide within the opening when the lever is being pulled by the first cable.

18. The line striper of claim 17, further comprising:

a first sheath surrounding at least a portion of the first cable, the first sheath having a first end and a second end, the first end of the first sheath at least partially surrounding the first end of the first cable; and a second sheath surrounding at least a portion of the second cable, the second sheath having a first end and a second end, the first end of the second sheath at least partially surrounding the first end of the second cable, wherein the first end of the first sheath and the first end of the second sheath remain stationary relative to each other as the first cable or the second cable moves the lever from the inactive position to the active position.

19. The line striper of claim 17, wherein the lever includes the at least one member extending from the lever, the first end of the first cable being mechanically linked to one of the at least one member and the first end of the second cable being mechanically linked to one of the at least one member.

20. The line striper of claim 19, wherein the at least one member extends into the opening in the first connector and also extends into the opening in the second connector.

* * * * *